US007500871B2

(12) United States Patent
Minich et al.

(10) Patent No.: US 7,500,871 B2
(45) Date of Patent: Mar. 10, 2009

(54) ELECTRICAL CONNECTOR SYSTEM WITH JOGGED CONTACT TAILS

(75) Inventors: Steven E. Minich, York, PA (US); Danny L. C. Morlion, Ghent (BE)

(73) Assignee: FCI Americas Technology, Inc., Carson City, NV (US)

( * ) Notice: Subject to any disclaimer, the term of this patent is extended or adjusted under 35 U.S.C. 154(b) by 0 days.

(21) Appl. No.: 11/837,847

(22) Filed: Aug. 13, 2007

(65) Prior Publication Data

US 2008/0045079 A1 Feb. 21, 2008

Related U.S. Application Data

(60) Provisional application No. 60/917,491, filed on May 11, 2007, provisional application No. 60/846,711, filed on Sep. 22, 2006, provisional application No. 60/839,071, filed on Aug. 21, 2006.

(51) Int. Cl.
*H01R 13/73* (2006.01)

(52) U.S. Cl. ..... 439/544

(58) Field of Classification Search ..... 439/108, 439/79, 65, 608, 607, 941, 101, 939, 544
See application file for complete search history.

(56) References Cited

U.S. PATENT DOCUMENTS

| | | | | |
|---|---|---|---|---|
| 2,664,552 | A | 12/1953 | Ericsson et al. | 339/192 |
| 2,849,700 | A | 8/1958 | Perkin | 339/198 |
| 2,858,372 | A | 10/1958 | Kaufman | 379/325 |
| 3,115,379 | A | 12/1963 | McKee | 439/290 |
| 3,286,220 | A | 11/1966 | Marley et al. | 439/680 |
| 3,343,120 | A | 9/1967 | Whiting | 339/19 |
| 3,482,201 | A | 12/1969 | Schneck | 339/19 |
| 3,538,486 | A | 11/1970 | Shlesinger, Jr. | 439/268 |
| 3,591,834 | A | 7/1971 | Kolias | 317/101 |
| 3,641,475 | A | 2/1972 | Irish et al. | 339/17 |

(Continued)

FOREIGN PATENT DOCUMENTS

EP 0 273 683 A2 7/1988

(Continued)

OTHER PUBLICATIONS

Nadolny, J. et al., "Optimizing Connector Selection for Gigabit Signal Speeds", *ECN*™, Sep. 1, 2000, http://www.ecnmag.com/article/CA45245, 6 pages.

(Continued)

*Primary Examiner*—Edwin A. Leon
(74) *Attorney, Agent, or Firm*—Woodcock Washburn LLP

(57) ABSTRACT

Connector systems include electrical connectors orthogonally connected to each other through shared through-holes in a midplane. An orthogonal vertical connector includes jogged contacts to offset for or equalize the different length contacts in the right-angle connector to which the vertical connector is connected. A first contact in the right angle connector may mate with a first contact in the vertical connector. A second contact in the right angle connector may mate with a second contact in the vertical connector. The first contact in the right angle connector may be greater in length than the adjacent second contact of the right angle connector. Thus, the second contact of the vertical connector may be jogged by the distance to increase the length of the second contact by the distance.

23 Claims, 25 Drawing Sheets

U.S. PATENT DOCUMENTS

| | | | | |
|---|---|---|---|---|
| 3,663,925 | A | 5/1972 | Proctor | |
| 3,669,054 | A | 6/1972 | Desso et al. | 113/119 |
| 3,701,076 | A | 10/1972 | Irish | 339/17 |
| 3,748,633 | A | 7/1973 | Lundergan | 339/217 S |
| 3,827,005 | A | 7/1974 | Friend | 339/258 |
| 3,867,008 | A | 2/1975 | Gartland, Jr. | 339/258 |
| 4,030,792 | A | 6/1977 | Fuerst | 339/17 |
| 4,076,362 | A | 2/1978 | Ichimura | 339/75 |
| 4,159,861 | A | 7/1979 | Anhalt | 339/75 |
| 4,232,924 | A | 11/1980 | Kline et al. | 339/17 |
| 4,260,212 | A | 4/1981 | Ritchie et al. | 339/97 R |
| 4,288,139 | A | 9/1981 | Cobaugh et al. | 339/74 R |
| 4,383,724 | A | 5/1983 | Verhoeven | 439/510 |
| 4,402,563 | A | 9/1983 | Sinclair | 339/75 |
| 4,482,937 | A | 11/1984 | Berg | 361/413 |
| 4,523,296 | A | 6/1985 | Healy, Jr. | 364/900 |
| 4,560,222 | A | 12/1985 | Dambach | 339/75 |
| 4,664,458 | A | 5/1987 | Worth | 339/17 |
| 4,717,360 | A | 1/1988 | Czaja | 439/710 |
| 4,762,500 | A | 8/1988 | Dola et al. | |
| 4,776,803 | A | 10/1988 | Pretchel et al. | 439/59 |
| 4,815,987 | A | 3/1989 | Kawano et al. | 439/263 |
| 4,850,887 | A | 7/1989 | Sugawara | |
| 4,867,713 | A | 9/1989 | Ozu et al. | 439/833 |
| 4,898,539 | A | 2/1990 | Glover et al. | 439/81 |
| 4,900,271 | A | 2/1990 | Colleran et al. | 439/595 |
| 4,907,990 | A | 3/1990 | Bertho et al. | 439/851 |
| 4,913,664 | A | 4/1990 | Dixon et al. | 439/607 |
| 4,917,616 | A | 4/1990 | Demler, Jr. et al. | 439/101 |
| 4,973,271 | A | 11/1990 | Ishizuka et al. | 439/839 |
| 4,997,390 | A | 3/1991 | Scholz et al. | 439/509 |
| 5,004,426 | A | 4/1991 | Barnett | 439/82 |
| 5,046,960 | A | 9/1991 | Fedder | 439/108 |
| 5,055,054 | A | 10/1991 | Doutrich | 439/66 |
| 5,065,282 | A | 11/1991 | Polonio | 361/399 |
| 5,066,236 | A | 11/1991 | Broeksteeg | 439/79 |
| 5,077,893 | A | 1/1992 | Mosquera et al. | 29/882 |
| 5,094,623 | A | 3/1992 | Scharf et al. | 439/101 |
| 5,098,311 | A | 3/1992 | Roath et al. | 439/289 |
| 5,127,839 | A | 7/1992 | Korsunsky et al. | 439/79 |
| 5,161,987 | A | 11/1992 | Sinisi | |
| 5,163,337 | A | 11/1992 | Herron et al. | 74/493 |
| 5,163,849 | A | 11/1992 | Fogg et al. | 439/497 |
| 5,167,528 | A | 12/1992 | Nishiyama et al. | 439/489 |
| 5,174,770 | A | 12/1992 | Sasaki et al. | 439/108 |
| 5,181,855 | A | 1/1993 | Mosquera et al. | 439/74 |
| 5,238,414 | A | 8/1993 | Yaegashi et al. | 439/108 |
| 5,254,012 | A | 10/1993 | Wang | 439/263 |
| 5,257,941 | A | 11/1993 | Lwee et al. | 439/65 |
| 5,274,918 | A | 1/1994 | Reed | 29/882 |
| 5,277,624 | A | 1/1994 | Champion et al. | 439/607 |
| 5,286,212 | A | 2/1994 | Broeksteeg | 439/108 |
| 5,288,949 | A | 2/1994 | Crafts | 174/250 |
| 5,302,135 | A | 4/1994 | Lee | 439/263 |
| 5,342,211 | A | 8/1994 | Broeksteeg | 439/108 |
| 5,356,300 | A | 10/1994 | Costello et al. | 439/101 |
| 5,356,301 | A | 10/1994 | Champion et al. | 439/108 |
| 5,357,050 | A | 10/1994 | Baran et al. | 174/33 |
| 5,382,168 | A | 1/1995 | Azuma et al. | 439/65 |
| 5,387,111 | A | 2/1995 | DeSantis et al. | 439/65 |
| 5,395,250 | A | 3/1995 | Englert, Jr. et al. | 439/65 |
| 5,429,520 | A | 7/1995 | Morlion et al. | 439/108 |
| 5,431,578 | A | 7/1995 | Wayne | 439/259 |
| 5,475,922 | A | 12/1995 | Tamura et al. | 29/881 |
| 5,522,727 | A | 6/1996 | Saito et al. | 439/65 |
| 5,558,542 | A | 9/1996 | O'Sullivan et al. | 439/682 |
| 5,575,688 | A | 11/1996 | Crane, Jr. | 439/660 |
| 5,586,908 | A | 12/1996 | Lorrain | 439/511 |
| 5,586,914 | A | 12/1996 | Foster, Jr. et al. | 439/676 |
| 5,590,463 | A | 1/1997 | Feldman et al. | 29/844 |
| 5,609,502 | A | 3/1997 | Thumma | 439/747 |
| 5,634,821 | A | 6/1997 | Crane, Jr. | 439/660 |
| 5,637,019 | A | 6/1997 | Crane, Jr. et al. | 439/677 |
| 5,672,064 | A | 9/1997 | Provencher et al. | 439/79 |
| 5,697,799 | A | 12/1997 | Consoli et al. | 439/181 |
| 5,713,746 | A | 2/1998 | Olson et al. | 439/79 |
| 5,730,609 | A | 3/1998 | Harwath | 439/108 |
| 5,741,144 | A | 4/1998 | Elco et al. | 439/101 |
| 5,741,161 | A | 4/1998 | Cahaly et al. | 439/709 |
| 5,766,023 | A | 6/1998 | Noschese et al. | |
| 5,795,191 | A | 8/1998 | Preputnick et al. | 439/608 |
| 5,817,973 | A | 10/1998 | Elco | 174/32 |
| 5,853,797 | A | 12/1998 | Fuchs et al. | 427/96 |
| 5,871,362 | A | 2/1999 | Campbell et al. | 439/67 |
| 5,876,222 | A | 3/1999 | Gardner et al. | 439/79 |
| 5,893,761 | A | 4/1999 | Longueville | 439/66 |
| 5,902,136 | A | 5/1999 | Lemke et al. | 439/74 |
| 5,904,581 | A | 5/1999 | Pope et al. | 439/74 |
| 5,908,333 | A | 6/1999 | Perino et al. | 439/631 |
| 5,938,479 | A | 8/1999 | Paulson et al. | 439/676 |
| 5,961,355 | A | 10/1999 | Morlion et al. | 439/686 |
| 5,967,844 | A | 10/1999 | Doutrich et al. | 439/607 |
| 5,971,817 | A | 10/1999 | Longueville | 439/857 |
| 5,980,321 | A | 11/1999 | Cohen et al. | 439/608 |
| 5,984,690 | A | 11/1999 | Riechelmann et al. | 439/66 |
| 5,992,953 | A | 11/1999 | Rabinovitz | 312/111 |
| 5,993,259 | A | 11/1999 | Stokoe et al. | 439/608 |
| 6,022,227 | A | 2/2000 | Huang | 439/79 |
| 6,042,427 | A | 3/2000 | Adriaenssens et al. | 439/676 |
| 6,050,862 | A | 4/2000 | Ishii | 439/843 |
| 6,068,520 | A | 5/2000 | Winings et al. | 439/676 |
| 6,086,386 | A | 7/2000 | Fjelstad et al. | 439/70 |
| 6,116,926 | A | 9/2000 | Ortega et al. | 439/108 |
| 6,116,965 | A | 9/2000 | Arnett et al. | 439/692 |
| 6,123,554 | A | 9/2000 | Ortega et al. | 439/79 |
| 6,125,535 | A | 10/2000 | Chiou et al. | 29/883 |
| 6,129,592 | A | 10/2000 | Mickievicz et al. | 439/701 |
| 6,139,336 | A | 10/2000 | Olson | 439/83 |
| 6,146,157 | A | 11/2000 | Lenoir et al. | 439/101 |
| 6,146,203 | A | 11/2000 | Elco et al. | 439/609 |
| 6,152,747 | A | 11/2000 | McNamara | 439/108 |
| 6,154,742 | A | 11/2000 | Herriot | 707/10 |
| 6,171,115 | B1 | 1/2001 | Mickievicz et al. | 439/76.1 |
| 6,171,149 | B1 | 1/2001 | Van Zanten | 439/608 |
| 6,179,663 | B1 | 1/2001 | Bradley et al. | 439/608 |
| 6,190,213 | B1 | 2/2001 | Reichart et al. | 439/736 |
| 6,212,755 | B1 | 4/2001 | Shimada et al. | 29/527.1 |
| 6,220,896 | B1 | 4/2001 | Bertoncici et al. | 439/608 |
| 6,227,882 | B1 | 5/2001 | Ortega et al. | 439/101 |
| 6,241,535 | B1 | 6/2001 | Lemke et al. | 439/83 |
| 6,267,604 | B1 | 7/2001 | Mickievicz et al. | 439/79 |
| 6,269,539 | B1 | 8/2001 | Takahashi et al. | 29/883 |
| 6,280,209 | B1 | 8/2001 | Bassler et al. | 439/101 |
| 6,293,827 | B1 | 9/2001 | Stokoe et al. | 439/608 |
| 6,299,483 | B1 | 10/2001 | Cohen et al. | 439/608 |
| 6,302,711 | B1 | 10/2001 | Ito | 439/83 |
| 6,319,075 | B1 | 11/2001 | Clark et al. | 439/825 |
| 6,322,379 | B1 | 11/2001 | Ortega et al. | 439/108 |
| 6,322,393 | B1 | 11/2001 | Doutrich et al. | 439/607 |
| 6,328,602 | B1 | 12/2001 | Yamasaki et al. | 439/608 |
| 6,343,955 | B2 | 2/2002 | Billman et al. | 439/608 |
| 6,347,952 | B1 | 2/2002 | Hasegawa et al. | 439/608 |
| 6,354,877 | B1 | 3/2002 | Shuey et al. | 439/608 |
| 6,358,061 | B1 | 3/2002 | Regnier | 439/60 |
| 6,361,366 | B1 | 3/2002 | Shuey et al. | 439/608 |
| 6,363,607 | B1 | 4/2002 | Chen et al. | 29/883 |
| 6,364,710 | B1 | 4/2002 | Billman et al. | 439/608 |
| 6,371,773 | B1 | 4/2002 | Crofoot et al. | 439/79 |
| 6,375,478 | B1 | 4/2002 | Kikuchi | 439/79 |
| 6,379,188 | B1 | 4/2002 | Cohen et al. | 439/608 |
| 6,386,914 | B1 | 5/2002 | Collins et al. | 439/579 |
| 6,390,826 | B1 | 5/2002 | Affolter et al. | 439/70 |
| 6,409,543 | B1 | 6/2002 | Astbury, Jr. et al. | 439/608 |
| 6,414,248 | B1 | 7/2002 | Sundstrom | 174/260 |

| | | | | |
|---|---|---|---|---|
| 6,420,778 | B1 | 7/2002 | Sinyansky | 257/664 |
| 6,431,914 | B1 | 8/2002 | Billman | 439/608 |
| 6,435,914 | B1 | 8/2002 | Billman | 439/608 |
| 6,461,202 | B2 | 10/2002 | Kline | 439/701 |
| 6,471,548 | B2 | 10/2002 | Bertoncini et al. | 439/608 |
| 6,482,038 | B2 | 11/2002 | Olson | 439/608 |
| 6,485,330 | B1 | 11/2002 | Doutrich | 439/572 |
| 6,494,734 | B1 | 12/2002 | Shuey | 439/378 |
| 6,503,103 | B1 | 1/2003 | Cohen et al. | 439/608 |
| 6,506,076 | B2 | 1/2003 | Cohen et al. | 439/608 |
| 6,506,081 | B2 | 1/2003 | Blanchfield et al. | 439/682 |
| 6,520,803 | B1 | 2/2003 | Dunn | 439/608 |
| 6,526,519 | B1 | 2/2003 | Cuthbert | 713/503 |
| 6,527,587 | B1 | 3/2003 | Ortega et al. | 439/608 |
| 6,537,086 | B1 | 3/2003 | Mac Mullin | 439/79 |
| 6,537,111 | B2 | 3/2003 | Brammer et al. | 439/857 |
| 6,540,522 | B2 | 4/2003 | Sipe | 439/61 |
| 6,540,558 | B1 | 4/2003 | Paagman | 439/608 |
| 6,540,559 | B1 | 4/2003 | Kemmick et al. | 439/608 |
| 6,547,066 | B2 | 4/2003 | Koch | 206/308.1 |
| 6,551,140 | B2 | 4/2003 | Billman et al. | 439/608 |
| 6,554,647 | B1 | 4/2003 | Cohen et al. | 439/607 |
| 6,565,388 | B1 | 5/2003 | Van Woensel et al. | 439/610 |
| 6,572,409 | B2 | 6/2003 | Nitta et al. | 439/608 |
| 6,572,410 | B1 | 6/2003 | Volstorf et al. | 439/608 |
| 6,592,381 | B2 | 7/2003 | Cohen et al. | 439/80 |
| 6,633,490 | B2 | 10/2003 | Centola et al. | 361/785 |
| 6,641,411 | B1 | 11/2003 | Stoddard et al. | 439/108 |
| 6,652,318 | B1 | 11/2003 | Winings et al. | 439/608 |
| 6,672,907 | B2 | 1/2004 | Azuma | 439/682 |
| 6,692,272 | B2 | 2/2004 | Lemke et al. | 439/108 |
| 6,695,627 | B2 | 2/2004 | Ortega et al. | 439/78 |
| 6,717,825 | B2 | 4/2004 | Volstorf | |
| 6,736,664 | B2 | 5/2004 | Ueda et al. | 439/423 |
| 6,746,278 | B2 | 6/2004 | Nelson et al. | 439/608 |
| 6,749,439 | B1 | 6/2004 | Potter et al. | 439/65 |
| 6,762,067 | B1 | 7/2004 | Quinones et al. | 438/11 |
| 6,764,341 | B2 | 7/2004 | Lappoehn | 439/608 |
| 6,776,649 | B2 | 8/2004 | Pape et al. | 439/485 |
| 6,799,215 | B1 | 9/2004 | Giroir et al. | 709/227 |
| 6,805,278 | B1 | 10/2004 | Olson et al. | |
| 6,808,399 | B2 | 10/2004 | Rothermel et al. | 439/108 |
| 6,808,420 | B2 | 10/2004 | Whiteman, Jr. et al. | 439/608 |
| 6,824,391 | B2 | 11/2004 | Mickievicz et al. | |
| 6,835,072 | B2 | 12/2004 | Simons et al. | 439/66 |
| 6,843,686 | B2 | 1/2005 | Ohnishi et al. | 439/608 |
| 6,848,944 | B2 | 2/2005 | Evans | 439/608 |
| 6,851,974 | B2 | 2/2005 | Doutrich | 439/572 |
| 6,851,980 | B2 | 2/2005 | Nelson et al. | 439/608 |
| 6,852,567 | B1 | 2/2005 | Lee et al. | 438/106 |
| 6,869,292 | B2 | 3/2005 | Johnescu et al. | 439/74 |
| 6,884,117 | B2 | 4/2005 | Korsunsky et al. | 439/607 |
| 6,890,214 | B2 | 5/2005 | Brown et al. | 439/608 |
| 6,893,300 | B2 | 5/2005 | Zhou et al. | 439/862 |
| 6,893,686 | B2 | 5/2005 | Egan | 427/496 |
| 6,902,411 | B2 | 6/2005 | Kubo | 439/74 |
| 6,913,490 | B2 | 7/2005 | Whiteman, Jr. et al. | 439/608 |
| 6,918,776 | B2 | 7/2005 | Spink, Jr. | 439/74 |
| 6,918,789 | B2 | 7/2005 | Lang et al. | 439/608 |
| 6,932,649 | B1 | 8/2005 | Rothermel et al. | 439/620 |
| 6,939,173 | B1 | 9/2005 | Elco et al. | 439/608 |
| 6,945,796 | B2 | 9/2005 | Bassler et al. | 439/101 |
| 6,951,466 | B2 | 10/2005 | Sandoval et al. | 439/74 |
| 6,953,351 | B2 | 10/2005 | Fromm et al. | 439/101 |
| 6,969,280 | B2 | 11/2005 | Chien et al. | 439/608 |
| 6,976,886 | B2 | 12/2005 | Winings et al. | |
| 6,981,883 | B2 | 1/2006 | Raistrick et al. | 439/74 |
| 6,994,569 | B2 | 2/2006 | Minich et al. | |
| 7,021,975 | B2 | 4/2006 | Lappohn | 439/733.1 |
| 7,044,794 | B2 | 5/2006 | Consoli et al. | 439/608 |
| 7,090,501 | B1 | 8/2006 | Scherer et al. | 439/61 |
| 7,094,102 | B2 | 8/2006 | Cohen et al. | 439/608 |
| 7,097,506 | B2 | 8/2006 | Nakada | 439/608 |
| 7,101,191 | B2 | 9/2006 | Benham et al. | 439/65 |
| 7,108,556 | B2 | 9/2006 | Cohen et al. | 439/608 |
| 7,118,391 | B2 | 10/2006 | Minich et al. | 439/79 |
| 7,131,870 | B2 | 11/2006 | Whiteman, Jr. et al. | 439/608 |
| 7,172,461 | B2 | 2/2007 | Davis et al. | 439/608 |
| 7,241,168 | B2 | 7/2007 | Sakurai et al. | 439/511 |
| 7,281,950 | B2 | 10/2007 | Belopolsky | 439/608 |
| 7,331,802 | B2 | 2/2008 | Rothermel et al. | |
| 2001/0012729 | A1 | 8/2001 | Van Woensel | 439/608 |
| 2002/0098727 | A1 | 7/2002 | McNamara et al. | |
| 2002/0106930 | A1 | 8/2002 | Pape et al. | 439/485 |
| 2002/0111068 | A1 | 8/2002 | Cohen et al. | 439/608 |
| 2002/0127903 | A1 | 9/2002 | Billman et al. | 439/378 |
| 2003/0143894 | A1 | 7/2003 | Kline et al. | 439/608 |
| 2003/0171010 | A1 | 9/2003 | Winings et al. | 439/55 |
| 2003/0203665 | A1 | 10/2003 | Ohnishi et al. | 439/79 |
| 2003/0220021 | A1 | 11/2003 | Whiteman et al. | 439/608 |
| 2004/0157477 | A1 | 8/2004 | Johnson et al. | 439/74 |
| 2004/0224559 | A1 | 11/2004 | Nelson et al. | |
| 2004/0235321 | A1 | 11/2004 | Mizumura et al. | 439/92 |
| 2005/0009402 | A1 | 1/2005 | Chien et al. | 439/608 |
| 2005/0032401 | A1 | 2/2005 | Kobayashi | 439/76.2 |
| 2005/0048838 | A1 | 3/2005 | Kornsunsky et al. | 439/607 |
| 2005/0079763 | A1 | 4/2005 | Lemke et al. | 439/582 |
| 2005/0101188 | A1 | 5/2005 | Benham et al. | 439/620 |
| 2005/0118869 | A1 | 6/2005 | Evans | 439/608 |
| 2005/0170700 | A1 | 8/2005 | Shuey et al. | 439/701 |
| 2005/0196987 | A1 | 9/2005 | Shuey et al. | 439/108 |
| 2005/0215121 | A1 | 9/2005 | Tokunga | 439/608 |
| 2005/0227552 | A1 | 10/2005 | Yamashita et al. | 439/862 |
| 2005/0277315 | A1 | 12/2005 | Mongold et al. | 439/108 |
| 2005/0287869 | A1 | 12/2005 | Kenny et al. | 439/620 |
| 2006/0014433 | A1 | 1/2006 | Consoli et al. | 439/608 |
| 2006/0024983 | A1 | 2/2006 | Cohen et al. | 439/61 |
| 2006/0046526 | A1 | 3/2006 | Minich | |
| 2006/0051987 | A1 | 3/2006 | Goodman et al. | 439/74 |
| 2006/0068641 | A1 | 3/2006 | Hull et al. | 439/608 |
| 2006/0073709 | A1 | 4/2006 | Reid | 439/65 |
| 2006/0116857 | A1 | 6/2006 | Sevic et al. | 703/13 |
| 2006/0121749 | A1 | 6/2006 | Fogg | |
| 2006/0192274 | A1 | 8/2006 | Lee et al. | 257/666 |
| 2006/0216969 | A1 | 9/2006 | Bright et al. | 439/79 |
| 2006/0228912 | A1 | 10/2006 | Morlion et al. | 439/65 |
| 2006/0232301 | A1 | 10/2006 | Morlion et al. | 326/126 |
| 2007/0004287 | A1 | 1/2007 | Marshall | 439/701 |
| 2007/0099455 | A1* | 5/2007 | Rothermel et al. | 439/108 |
| 2007/0205774 | A1* | 9/2007 | Minich | 324/538 |
| 2007/0207641 | A1* | 9/2007 | Minich | 439/79 |

FOREIGN PATENT DOCUMENTS

| | | |
|---|---|---|
| EP | 0 891 016 | 10/2002 |
| EP | 1 148 587 B1 | 4/2005 |
| JP | 06-236788 | 8/1994 |
| JP | 07-114958 | 5/1995 |
| JP | 11/185886 | 7/1999 |
| JP | 2000-003743 | 1/2000 |
| JP | 2000-003744 | 1/2000 |
| JP | 2000-003745 | 1/2000 |
| JP | 2000-003746 | 1/2000 |
| WO | WO 90/16093 | 12/1990 |
| WO | WO 01/29931 A1 | 4/2001 |
| WO | WO 01/39332 A1 | 5/2001 |
| WO | WO 02/101882 | 12/2002 |
| WO | WO 2006/031296 A2 | 3/2006 |
| WO | WO 2006031296 A2 | 3/2006 |

OTHER PUBLICATIONS

"PCB-Mounted Receptacle Assemblies, 2.00 mm(0.079in) Centerlines, Right-Angle Solder-to-Board Signal Receptacle", *Metral*™, Berg Electronics, 10-6-10-7, 2 pages.

*Metral*™, "Speed & Density Extensions", *FCI*, Jun. 3, 1999, 25 pages.

Framatome Connector Specification, 1 page.
Millipacs Connector Type A Specification, 1 page.
Fusi, M.A. et al., "Differential Signal Transmission through Backplanes and Connectors", *Electronic Packaging and Production*, Mar. 1996, 27-31.
Goel, R.P. et al., "AMP Z-Pack Interconnect System", 1990, AMP Incorporated, 9 pages.
"FCI's Airmax VS® Connector System Honored at DesignCon", 2005, Heilind Electronics, Inc., http://www.heilind.com/products/fci/airmax-vs-design.asp, 1 page.
Hult, B., "FCI's Problem Solving Approach Changes Market, The FCI Electronics AirMax VS®", ConnectorSupplier.com, Http://www.connectorsupplier.com/tech_updates_FCI-Airmax_archive.htm, 2006, 4 pages.
Backplane Products Overview Page, http://www.molex.com/cgi-bin/bv/molex/super_family/super_family.jsp?BV_Session ID=@, 2005-2006 © Molex, 4 pages.
AMP Z-Pack 2mm HM Interconnection System, 1992 and 1994 © by AMP Incorporated, 6 pages.
Metral® 2mm High-Speed Connectors, 1000, 2000, 3000 Series, Electrical Performance Data for Differential Applications, FCI Framatome Group, 2 pages.
HDM® HDM Plus® Connectors, http://www.teradyne.com/prods/tcs/products/connectors/backplane/hdm/index.html, 2006, 1 page.
Amphenol TCS (ATCS):HDM® Stacker Signal Integrity, http://www.teradyne.com/prods/tcs/products/connectors/mezzanine/hdm_stacker/signintegr, 3 pages.
Amphenol TCS (ATCS): VHDM Connector, http://www.teradyne.com/prods/tcs/products/connectors/backplane/vhdm/index.html, 2 pages.
VHDM High-Speed Differential (VHDM HSD), http://www.teradyne.com/prods/bps/vhdm/hsd.html, 6 pages.
Amphenol TCS(ATCS): VHDM L-Series Connector, http://www.teradyne.com/prods/tcs/products/connectors/backplane/vhdm_1-series/index.html, 2006, 4 pages.
VHDM Daughterboard Connectors Feature press-fit Terminations and a Non-Stubbing Seperable Interface, © Teradyne, Inc. Connections Systems Division, Oct. 8, 1997, 46 pages.
HDM/HDM *plus*, 2mm Backplane Interconnection System, Teradyne Connection Systems, © 1993, 22 pages.
HDM Separable Interface Detail, Molex®, 3 pages.
"Lucent Technologies' Bell Labs and FCI Demonstrate 25gb/S Data Transmission over Electrical Backplane Connectors", Feb. 1, 2005, http://www.lucent.com/press/0205/050201.bla.html, 4 pages.
"B.? Bandwidth and Rise Time Budgets", Module 1-8. Fiber Optic Telecommunications (E-XVI-2a), http://cord.org/step_online/st1-8/st18exvi2a.htm, 3 pages.
"Tyco Electronics, Z-Dok and Connector", Tyco Electronics, Jun. 23, 2003, http://2dok.tyco.elcetronics.com, 15 pages.
Tyco Electronics/AMP, "Z-Dok and Z-Dok and Connectors", Application Specification # 114-13068, Aug. 30, 2005, Revision A, 16 pages.
Tyco Electronics, "Champ Z-Dok Connector System", Catalog # 1309281, Issued Jan. 2002, 3 pages.
GIG-ARRAY® High Speed Mezzanine Connectors 15-40 mm Board to Board, Jun. 5, 2006, 1 page.
Communications, Data, Consumer Division Mezzanine High-Speed High-Density Connectors GIG-ARRAY® and MEG-ARRAY® electrical Performance Data, 10 pages FCI Corporation.
AMP Z-Pack 2mm HM Connector, 2mm Centerline, Eight-Row, Right-Angle Applications, Electrical Performance Report, EPR 889065, Issued Sep. 1998, 59 pages.
AMP Z-Pack HM-Zd Performance at Gigabit Speeds, Tyco Electronics, Report #20GC014, Rev.B., May 4, 2001, 30 pages.
Honda Connectors, "Honda High-Speed Backplane Connector NSP Series", Honda Tsushin Kogoyo Co., Ltd., Development Engineering Division, Tokyo , Japan, Feb. 7, 2003, 25 pages.
NSP, Honda The World Famous Connectors, http://www.honda-connectors.co.jp, 6 pages, English Language Translation attached.
4.0 UHD Connector: Differential Signal Crosstalk, Reflections, 1998, p. 8-9.
US 5,834,475, (withdrawn).
TB-2127 "VENTURA™ Application Design", Revision, "General Release", Specification Revision Status-B. Hurisaker, Aug. 25, 2005, Amphenol Corporation 2006, 1-13.
Teradyne Connection Systems, Inc., Customer Use Drawing No. C-163-5101-500, Rev. 04, no date.
Tyco Electronics, Overview for High Density Backplane Connector (Z-Pack TinMan), 2005, 1 page.
Tyco Electronics, Z-Pack TinMan Product Portfolio Expanded to Include 6-Pair Module, 2005, 1 page.
Molex Incorporated Drawings, 1.0 HDMI Right Angle Header Assembly (19 PIN) Lead Free, Jul. 20, 2004, 7 pages.
Airmax VS®, High Speed Connector System, Communications, Data, Consumer Division, 2004, 16 pages.
Amphenol TCS (ATCS)-XCede® Connector, 2002, www.amphenol-tcs.com, 5 pages.
Amphenol TCS (ATCS)-Ventura® High Performance, Highest Density Available, 2002, www.amphenol-tcs.com, 2 pages.
Amphenol TCS (ATCS)-, Backplane Connnectors, 2002, www.amphenol-tcs.com, 3 pages.
Backplane Products, www.molex.com, 2007, 3 pages.
Molex Features and Specifications, www.molex.com/link/Impact.html, May 2008, 5 pages.
Molex, GbXI-Trac™ Backplane Connector System, www.molex.com/cgi-bin, 2007, 3 pages.
Tyco Electronics, Two-Piece, High-Speed Connectors, www.tycoelectronics.com/catalog, 2007, 3 pages.
Tyco Electronics, Overview for High Density Backplane Connectors (Impact™) Offered by Tyco Electronics, www.tycoelectronics.com/catalog, 2007, 2 pages.
Tyco Electronics, Impact™ Connector Offered by Tyco Electronics, High Speed Backplane Connector System, Apr. 15, 2008, 12 pages.
Tyco Electronics, Z-Pack Slim UHD, http://www.zpackuhd.com, 2005, 8 pages.
Tyco Electronics Engineering Drawing, Impact, 3 Pair 10 Column Signal Module, Mar. 25, 2008, 1 page.
Tyco Electronics Engineering Drawing, Impact, 3 Pair Header Unguided Open Assembly, Apr. 11, 2008, 1 page.
Molex, High Definition Multimedia Interface (HDMI), www.molex.com, 2 pages, no date.
Samtec, E.L.P. Extended Life Product, Open Pin Field Array Seaf Series, 2005, www.samtec.com, 1 page.
Samtec, High Speed Characterization Report, SEAM-30-02.0-S-10-2 Mates with SEAF-30-05.0-S-10-2, Open Pin Field Array, 1.27mm x 1.27 mm Pitch 7 mm Stack Height, 2005, www.samtec.com, 51 pages.
Provisional Patent Application, Cohen, U.S. Appl. No. 60/584,928, filed Jul. 1, 2004.

* cited by examiner

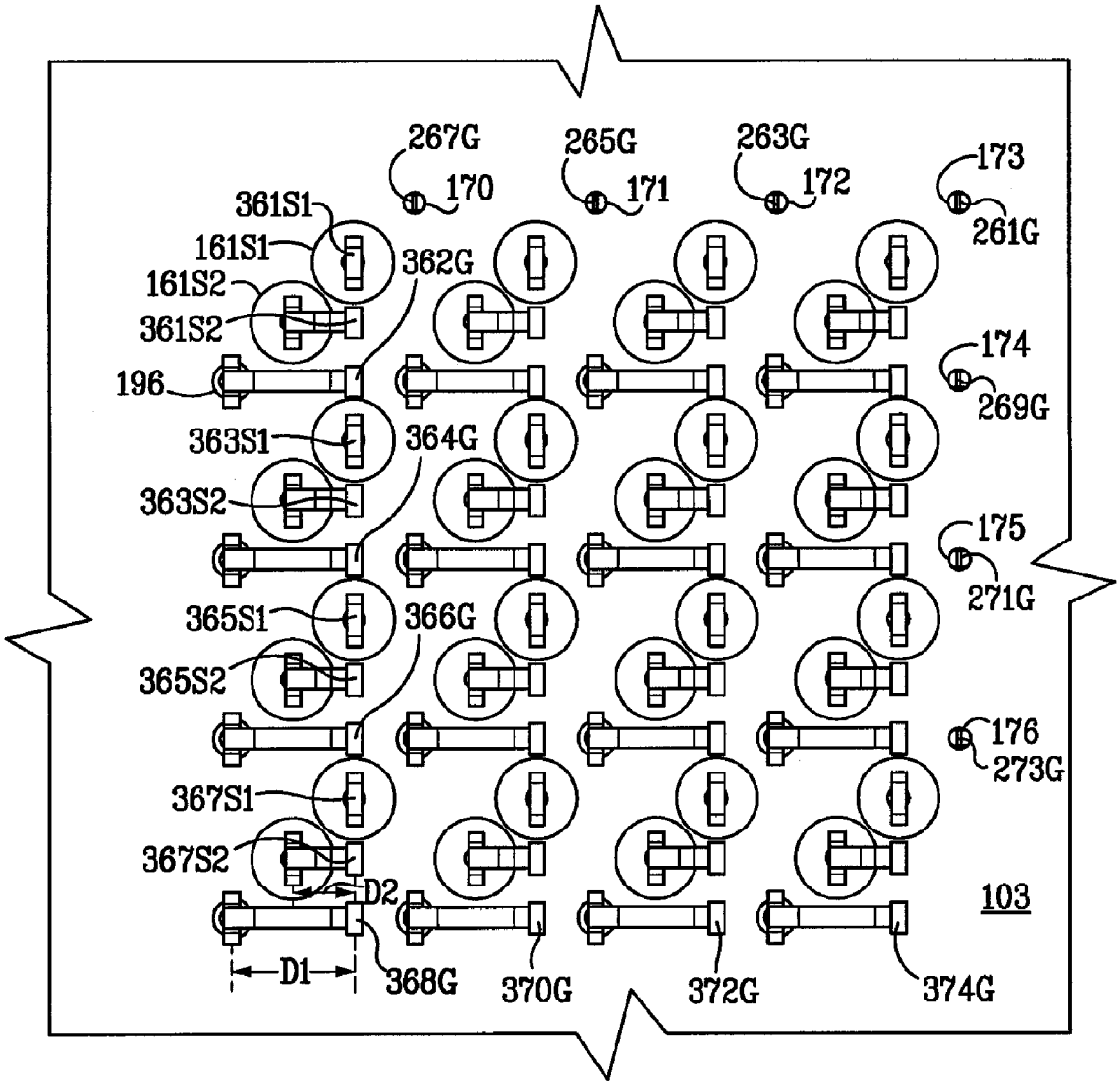
FIG. 7B
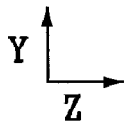

ELECTRICAL CONNECTOR SYSTEM WITH JOGGED CONTACT TAILS

CROSS-REFERENCE TO RELATED APPLICATIONS

This application claims benefit under 35 U.S.C. § 119(e) of provisional U.S. patent application No. 60/839,071, filed Aug. 21, 2006, and of provisional U.S. patent application No. 60/846,711, filed Sep. 22, 2006, and of provisional U.S. patent application No. 60/917,491, filed May 11, 2007, entitled "Skewless Electrical Connector."

The subject matter of this application is related to that of U.S. patent application Ser. No. 10/294,966, filed Nov. 14, 2002, now U.S. Pat. No. 6,976,886; U.S. patent application Ser. No. 10/634,547, filed Aug. 5, 2003, now U.S. Pat. No. 6,994,569; and U.S. patent application Ser. No. 11/052,167, filed Feb. 7, 2005.

The contents of each of the foregoing patent applications and patents are incorporated herein by reference in their entireties. The subject matter of this application is related to that of U.S. patent application Ser. No. 10/953,749, filed Sep. 29, 2004, entitled "High Speed Connectors that Minimize Signal Skew and Crosstalk." The subject matter of this application is also related to that of U.S. patent application Ser. No. 11/388,549, filed Mar. 24, 2006, entitled "Orthogonal Backplane Connector," U.S. patent application Ser. No. 11/958,098, filed Dec. 17, 2007, entitled "Shieldless, High-Speed, Low-Cross-Talk Electrical Connector," U.S. patent application Ser. No. 11/388,549, filed Mar. 24, 2006, entitled "Orthogonal Backplane Connector," and U.S. patent application Ser. No. 11/855,339, filed Sep. 14, 2007, entitled "High Speed Connectors That Minimize Signal Skew and Crosstalk."

FIELD OF THE INVENTION

Generally, the invention relates to electrical connectors. More particularly, the invention relates to connector applications wherein orthogonally-mated connectors share common holes through a midplane. The invention further relates to skew correction for right-angle electrical connectors.

BACKGROUND OF THE INVENTION

Right-angle connectors are well-known. A right-angle connector is a connector having a mating interface for mating with another connector and a mounting interface for mounting on a printed circuit board. The mating and mounting interfaces each define a plane, and the two planes are perpendicular (i.e., at a right angle) to each other. Thus, a right-angle connector can be used to electrically connect two boards perpendicularly to one another.

In a right-angle connector, one contact of a differential signal contact pair may be longer than the other contact of the pair. The difference in length in the contacts of the pair may create a different signal propagation time in one contact with respect to the other contact. It may be desirable to minimize this skew between contacts that form a differential signal pair in a right-angle connector.

Electrical connectors may be used in orthogonal applications. In an orthogonal application, each of two connectors is mounted to a respective, opposite side of a so-called "midplane." The connectors are electrically coupled to one another through the midplane. A pattern of electrically conductive holes may be formed through the midplane. The terminal mounting ends of the contacts may be received into the holes.

To reduce the complexity of the midplane, it is often desirable that the terminal mounting ends of the contacts from a first of the connectors be received into the same holes as the terminal mounting ends of the contacts from the other connector.

Additional background may be found in U.S. Pat. Nos. 5,766,023, 5,161,987, and 4,762,500, and in U.S. patent application Ser. No. 11/388,549, filed Mar. 24, 2006, entitled "Orthogonal Backplane Connector," the contents of each of which are incorporated by reference in their entireties.

SUMMARY OF THE INVENTION

Connector systems according to aspects of the invention may include electrical connectors orthogonally connected to each other through shared through-holes in a midplane. Each orthogonal connector may be a vertical connector that is connected to a respective right-angle connector. A header or vertical connector may be used to affect (e.g., reduce, minimize, correct) the skew resultant from such differing contact lengths in the right angle connector. That is, the longer signal contact in the right-angle connector can be matched with the shorter signal contact in the header connector, and the shorter signal contact in the right-angle connector can be matched with the longer signal contact in the header connector.

By jogging the longer signal contacts in the header connector by the right amount, skew between the longer and shorter signal contacts in the right-angle connector may be eliminated or reduced. The vertical connector thus may include jogged contacts to offset for or equalize the different length contacts in the right-angle connector. For example, a first contact in the right angle connector may mate with a first contact in the vertical connector. A second contact in the right angle connector may mate with a second contact in the vertical connector. The first contact in the right angle connector may be greater in length than the adjacent second contact of the right angle connector. Thus, the second contact of the vertical connector may be jogged by the distance to increase the length of the second contact by the distance. When a signal is sent through the first and second contacts of the right angle and vertical connectors, for example, from the daughter card to the midplane, the signals will reach the midplane 100 simultaneously.

BRIEF DESCRIPTION OF THE DRAWINGS

FIG. 7B depicts the first embodiment electrical connector of FIG. 7A with a housing of the connector hidden.

DETAILED DESCRIPTION OF ILLUSTRATIVE EMBODIMENTS

Figure 1:
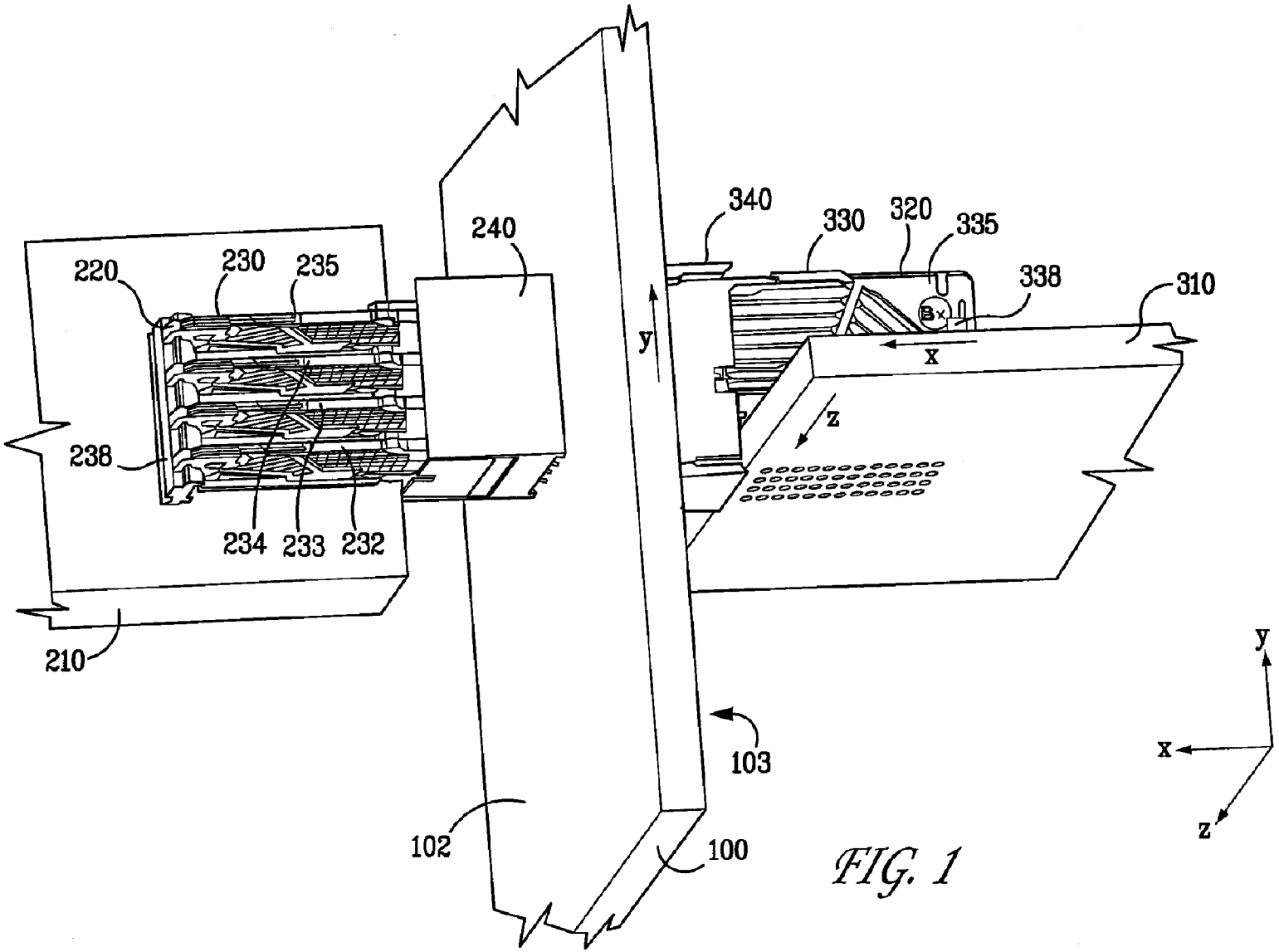
FIG. 1 depicts a pair of first embodiment electrical connectors mounted orthogonally to one another through use of shared holes in a midplane, each connector also mated with a respective right-angle connector that is mounted on a respective daughtercard.

FIGS. 1 through 13 depict various aspects of an example embodiment electrical connector system according to the invention. FIG. 1 depicts a pair of first embodiment electrical connectors 240, 340 mounted orthogonally (e.g., the connector 240 may be rotated 90° with respect to the connector 340) to one another through use of shared holes in a midplane 100. Each connector 240, 340 may also be mated with a respective right-angle connector 230, 330 that is mounted on a respective daughtercard 210, 310. The connectors 240, 340 mounted on the midplane 100 may be vertical or header connectors. A first vertical connector 340 may be mounted to a first side 103 of the midplane 100, and a second vertical connector 240 may be mounted to a second side 102 of the midplane 100.

The midplane 100 may define a pattern of holes that extend from the first side 103 of the midplane 100 to the second side 102. Each of the vertical connectors 240, 340 may define contact tail patterns that correspond to the midplane-hole pattern. Accordingly, each hole may receive a respective contact from each of the connectors 240, 340. Thus, the connectors "share" the holes defined by the midplane 100.

Each of the right-angle connectors 230, 330 may be connected to a respective daughtercard 210, 310. The first connector 330 may be mounted on a daughtercard 310 that is horizontal. That is, the daughtercard 310 may lie in a plane defined the arrows designated X and Z shown in FIG. 1. Of course, this "horizontal" designation may be arbitrary. The second connector 230 may be mounted to a daughtercard 210 that is "vertical." That is the daughtercard 210 may lie in a plane defined by the arrows designated X and Y shown in FIG. 1. Thus the connector system 320 comprising the header or vertical connector 340 and the right-angle connector 330 may be called the horizontal connector system 320 or horizontal connector 320. The connector system 220 comprising the header or vertical connector 240 and the right-angle connector 230 may be called the vertical connector system 220 or the vertical connector 220. The daughtercards 210, 310 thus may be orthogonal to one another, and to the midplane 100.

Each right-angle connector 230, 330 may include lead frame assemblies 232-235, 335, with each including contacts extending from a mating interface of the connector 230, 330 (where the connector mates with a respective vertical connector 240, 340) to a mounting interface (where the connector is mounted on a respective daughtercard 210, 310). The lead frame assemblies 232-235, 335 may be retained within a respective right-angle connector 230, 330 by a respective retention member 238, 338.

Figure 2:
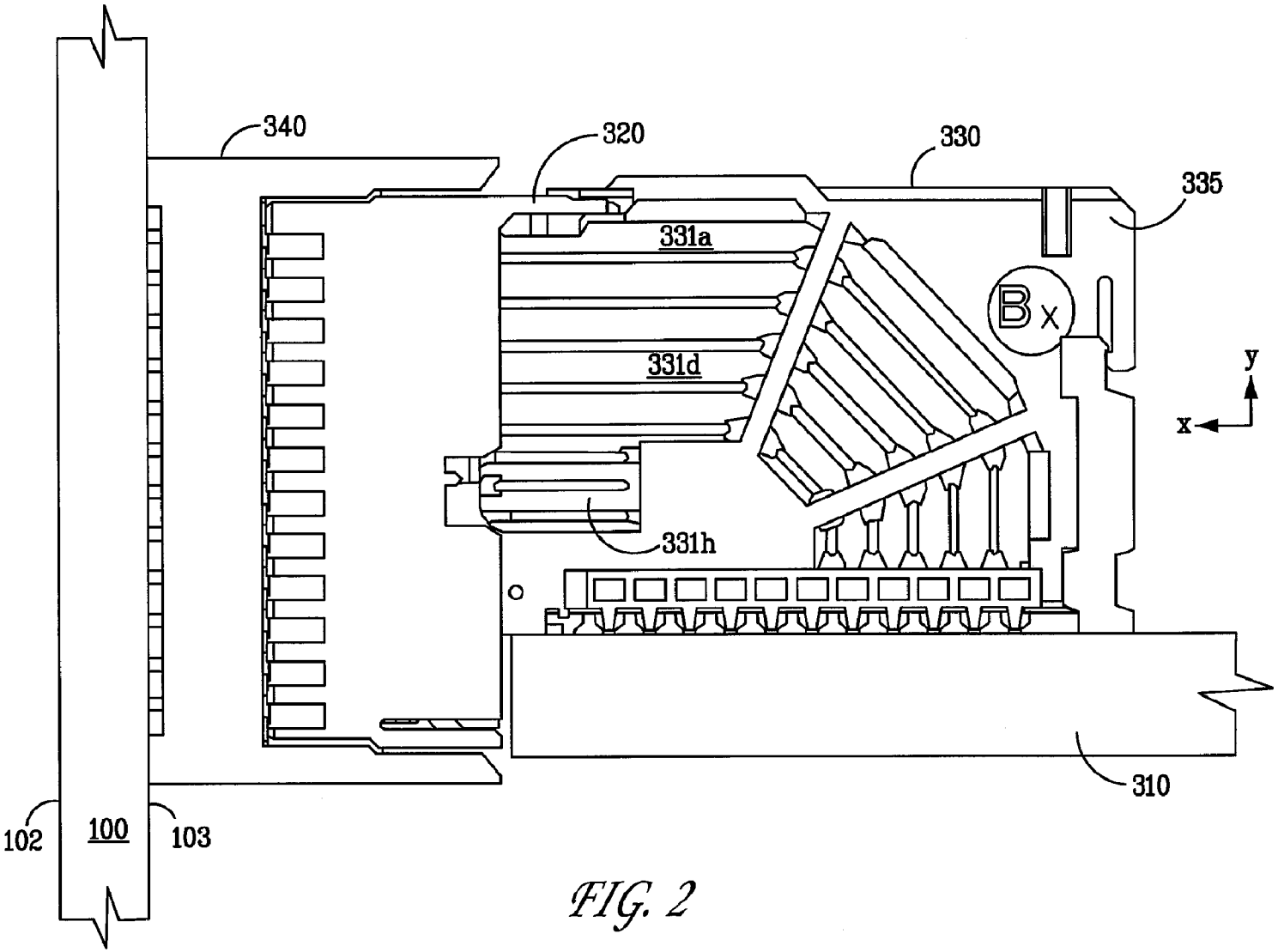
FIG. 2 is a side view of a first embodiment electrical connector mounted on a midplane and mated with a right-angle connector that is mounted on a daughtercard.

FIG. 2 is a side view of the first embodiment electrical connector system 330 mounted on the midplane 100 and the daughtercard 310. The side view of FIG. 2 depicts the connector system 320 in the plane defined by the X and Y arrows, as shown in FIGS. 1 and 2. The connector system 320 may include the vertical connector 340 and the right-angle connector 330. The vertical connector 340 may be mounted on the first midplane side 103 of the midplane 100 and be electrically and physically connected to the right-angle connector 330. The right angle connector 330 may be mounted on the daughtercard 310. The connector 340 and the connector 330 may form the connector system 320. The connector system 320 electrically connects the daughtercard 310 to the midplane 100 through, for example, contacts extending within the lead frame assembly 335 of the right-angle connector 330 that are electrically connected to contacts within the vertical connector 340.

The contacts within the right-angle connector 330 may be of differing lengths. For example, contacts that connect to the daughtercard 310 at a location further from the midplane 100 in a direction opposite that indicated by the arrow X may be longer than contacts mounted on the daughtercard 310 at a location closest to the midplane 100 in the opposite X direction. For example, a contact 331A located at the "top" of the leadframe assembly 335—that is, at a location furthest from the daughtercard 310—may be longer than a contact 331D located in a mid-portion of the leadframe assembly 335. The contact 331D likewise may be longer than a contact 331H located near the "bottom" of the leadframe assembly 335.

The connector system 320 and the connector system 220 shown in FIG. 1 may be the same as each other, and may be mounted orthogonally to opposite sides 102, 103 of the midplane 100. Thus while FIG. 2 shows the connector system 320 in the plane defined by the X and Y arrows, a similar view of the connector system 220 may be viewed in the plane defined by the X and Z arrows shown in FIG. 1.

Figure 3A:
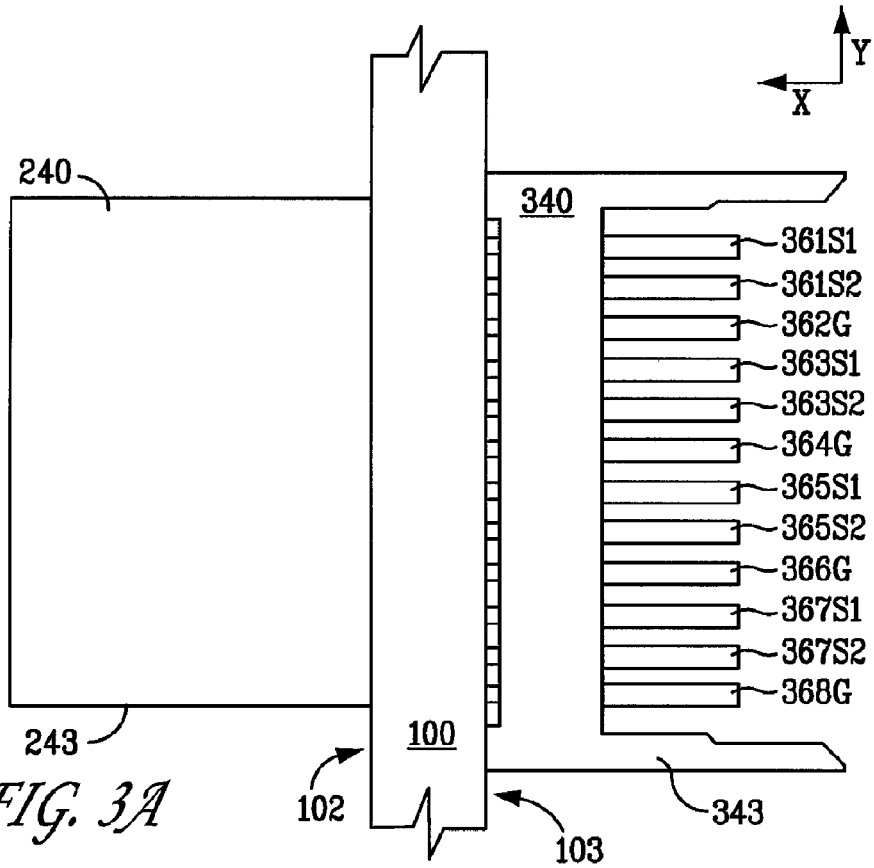
FIG. 3A is a side view (in the Z direction of FIG. 1) of first embodiment electrical connectors mounted orthogonally to one another through use of shared holes in a midplane.
Figure 3B:
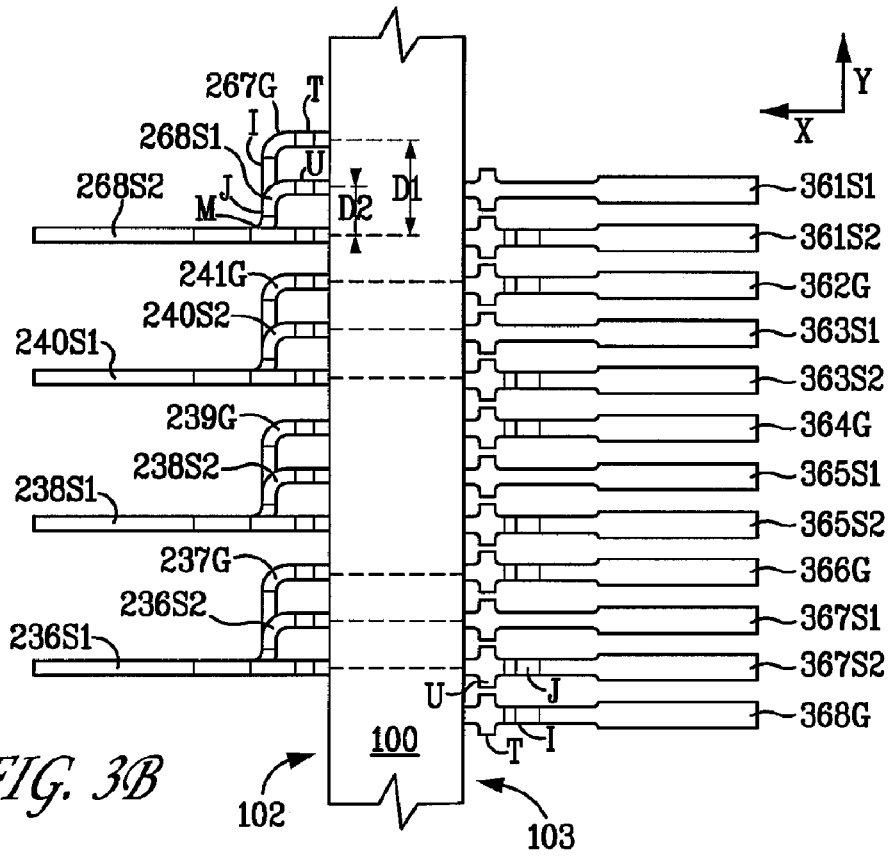
FIG. 3B is a side view (in the Z direction of FIG. 1) as shown in FIG. 3A but with respective connector housings hidden, thus showing contact arrangements within the first embodiment electrical connectors.

FIG. 3A is a side view of first embodiment vertical electrical connectors 240, 340 mounted orthogonally to one another through use of shared holes in sides 102, 103 the midplane 100. FIG. 3B is a side view as shown in FIG. 3A but with respective connector housings 243, 343 hidden, thus showing contact arrangements within the first embodiment electrical connectors 240, 340. The views of the connectors 240, 340 in FIGS. 3A and 3B are in the direction indicated by the Z arrow shown in FIG. 1.

As shown, the vertical connectors 240, 340 are "male" or "plug" connectors. That is, the mating portions of the contacts in the vertical connectors 240, 340 are blade shaped. Thus the vertical connectors 240, 340 may be header connectors. Correspondingly, the right-angle connectors 230, 330 (FIGS. 1 and 2) are receptacle connectors. That is, the mating portions of the contacts in the right-angle connectors 230, 330 are configured to receive corresponding blade contacts from the vertical connectors 240, 340. It should be understood, of course, that the vertical connectors 240, 340 could be receptacle connectors and the right-angle connectors 230, 330 could be header connectors.

The connectors 240, 340 may each include electrical contacts in a signal-signal-ground orientation or designation. Such orientation or designation may provide for differential signaling through the electrical connectors 240, 340. Of course, alternative embodiments of the invention may be used for single-ended signaling as well. Other embodiments may implement shields in lieu of ground contacts or connectors devoid of ground contacts and/or shields.

The contacts of each of the connectors 240, 340 may be arranged in arrays of rows and columns. Each column of contacts of the connector 340 may extend in the direction indicated by the Y arrow and each row of contacts of the connector 340 may extend in the direction indicated by the Z arrow of FIG. 1. Conversely (and because of the orthogonal relationship of the connectors 240, 340), each column of contacts of the connector 240 may extend in the direction indicated by the arrow Z of FIG. 1, and each row of contacts of the connector 240 may extend in the direction indicated by the arrow Y. Of course, the designation of the direction of rows versus columns is arbitrary.

In the example embodiments of FIGS. 3A and 3B, adjacent signal contacts in each column form respective differential signal pairs. Each column may begin with a ground contact, such as a contact 368G (a so-called "outer ground"), and may end with a signal contact, such as a contact 361S1. Each row also may begin with a ground contact, such as a contact 267G, and may end with a signal contact, such as a contact 236S1. It should be understood that the contacts may be arranged in any combination of differential signal pairs, single-ended signal conductors, and ground contacts in either the row or column direction.

The first vertical connector 340 may include contacts 361S1-368G arranged in a column of contacts. The contacts 361S1, 361S2 of the first connector 340 may mate with contacts 268S1, 268S2, respectively, of the second connector 240 through shared holes of the midplane 100. Contacts 363S1, 363S2 of the first connector 340 may mate with contacts 240S2, 240S1, respectively, of the second connector 240 through shared holes. The remaining signal contacts, as well as ground contacts, of the first vertical connector 340 likewise may be mated with respective contacts of the second vertical connector 240 through shared holes of the midplane 100. Such mating within the midplane 100 is shown by the dashed lines.

As described herein, the vertical connector 240 may be electrically connected to the right angle connector 230. The right angle connector 230 may include contacts that have different lengths than other contacts in the right angle connector 230. As described with respect to FIG. 1, for example, contacts in the right angle connector 230 nearest the daughtercard 210 may be shorter than contacts further from the daughtercard 210. Such different lengths may affect the properties of the connector 230 and the connector system 220. For example, signals may propagate through a shorter contact in the right angle connecter 230 in a shorter amount of time than a longer contact, resulting in signal skew.

Skew results when the contacts that form a pair have different lengths (and, therefore, provide different signal propagation times). Skew is a known problem in right-angle connectors because, as shown in FIG. 1, the adjacent contacts that form a pair differ in length—the contacts nearer to the top of the column may be longer (as measured linearly from mating end to mounting end) than the contacts that are nearer to the bottom of the column.

A vertical connector according to the invention may be used to affect (e.g., reduce, minimize, correct) the skew resultant from such differing signal contact lengths. That is, the longer signal contact in the right-angle connector can be matched with the shorter signal contact in the vertical connector, and the shorter signal contact in the right-angle connector can be matched with the longer signal contact in the vertical connector. By jogging the longer signal contact in the vertical connector by the right amount, skew between the longer and shorter signal contacts in the right-angle connector could be eliminated. It should be understood, of course, that other performance characteristics, such as impedance, insertion loss, and cross-talk, for example, may also be affected by the length of the jogged interim portions. It should be understood, therefore, that the skew correction technique described herein may be used to affect skew, even if not to eliminate it. Note that such skew correction may be employed even in a non-orthogonal application because the skew correction relies only on the right-angle/vertical connector combination, and not on anything within the midplane or related to the other connector combination on the other side of the midplane.

As described in more detail herein, the vertical connector 240 thus may include jogged contacts to offset for or equalize the different length contacts in the right-angle connector 230. For example, a first contact in the right angle connector 230 may mate with a first contact in the vertical connector 240. A second contact in the right angle connector 230 may mate with a second contact in the vertical connector 240. The first contact in the right angle connector 230 may be greater in length by a distance D1 than the adjacent second contact of the right angle connector 230. Thus, the second contact of the vertical connector 240 may be jogged by the distance D1 to increase the length of the second contact by a distance D1. When a signal is sent through the first and second contacts of the right angle and vertical connectors, for example, from the daughter card 210 to the midplane 100, the signals will reach the midplane 100 simultaneously.

Within the dielectric vertical connector housing 243, 343 of respective connectors 240, 340, interim portions of the ground contacts extend (or jog) a first distance D1 (e.g., 2.8 mm) at an angle (e.g., 90°) from an end of the mating portion M (i.e., the blade portion) of the contact. Such an interim portion is designated "I" on the ground contact 267G. A terminal portion—designated T on the ground contact 267G—of each ground contact extends at an angle (e.g., 90°) from the jogged portion, parallel to the mating portion. For each signal pair, one signal contact may have a jogged interim portion J that extends a second distance D2 (e.g., 1.4 mm) at an angle (e.g., 90°) from an end of the mating portion (i.e., the blade portion)—designated "J" on the signal contact 268S1—of the contact. A terminal portion U of each first signal contact extends at an angle (e.g., 90°) from the jogged portion, parallel to the mating portion. The distance D2 may be chosen based on the differing lengths of adjacent contacts within a right angle connector such as the right angle connector 230. A second signal contact—such as the contact 268S2—in each pair does not include a jogged interim portion. Accordingly, the terminal portion of each second signal contact extends from the mating portion M along the same line as the mating portion. It should be understood that the second signal contacts could include a jogged interim portion, wherein the jogged interim portions of the second signal contacts extend at an angle from the mating portions by a third distance that is less than the second distance.

Thus, jogging the lengths of mating signal contacts may equalize the lengths of the electrical connection between the midplane 100 and the daughtercard 210 through the contacts 268S1, 268S2 and the respective contacts of the right angle connector 230 to which the contacts 268S1, 268S2 may be connected.

It should be noted that the tail ends of the contacts within the vertical connectors 240, 340 may be jogged in the same direction, and that the tails may be equally-spaced apart from one another. For example, with reference to the connector 240 as shown in FIGS. 3A, 3B, the tail portions of the contacts in the second connector 240 all may be jogged in the direction indicated by the Y arrow. Also, for example, with reference to the connector 340 as show in FIGS. 3A, 3B, the tail portions of the contacts in the first connector 340 all may be jogged in the direction opposite the direction indicated by the arrow Z of FIG. 1—that is, jogged in a direction out of the page.

Figure 4A:
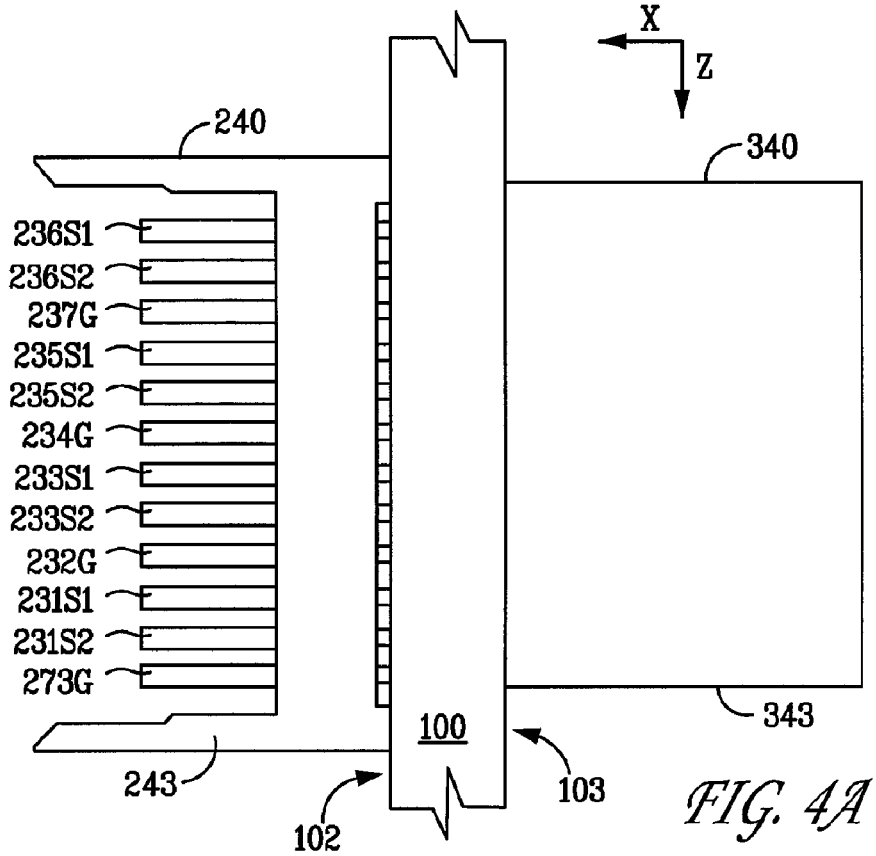
FIG. 4A is a bottom view (in the Y direction of FIG. 1) of the first embodiment electrical connectors mounted orthogonally to one another through use of shared holes in a midplane.
Figure 4B:
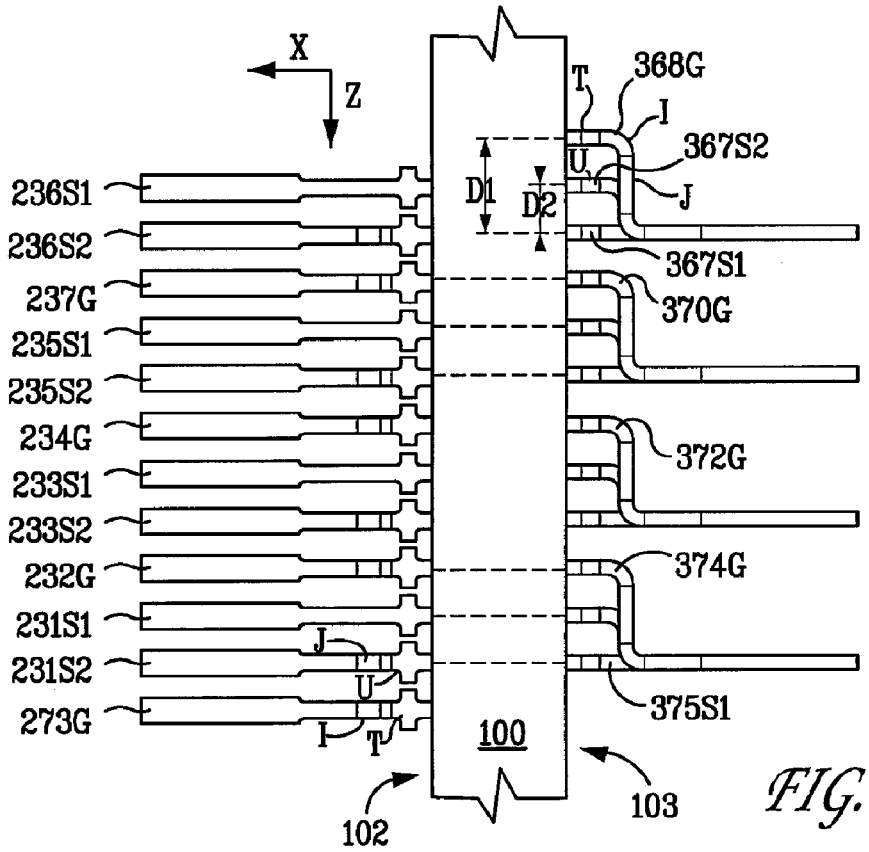
FIG. 4B is a bottom view (in the Y direction of FIG.1) as shown in FIG. 4A but with respective connector housings hidden, thus showing contact arrangements within the first embodiment electrical connectors.

FIG. 4A is a bottom view of first embodiment vertical electrical connectors 240, 340 mounted orthogonally to one another through use of shared holes in sides 102, 103 of the midplane 100. FIG. 4B is a bottom view as shown in FIG. 4A but with respective connector housings 243, 343 hidden, thus showing contact arrangements within the first embodiment electrical connectors 240, 340. The views of the connectors 240, 340 in FIGS. 4A and 4B are in the direction indicated by the Y arrow shown in FIG. 1.

In the example embodiments of FIGS. 4A and 4B, adjacent signal contacts in each column of the second vertical connector 240 form respective differential signal pairs. Each column may begin with a ground contact, such as a contact 273G (an outer ground), and may end with a signal contact, such as a contact 236S1. Each row of contacts of the vertical connector 340 also may begin with a ground contact, such as a ground contact 368G, and may end with a signal contact, such as a signal contact 375S1.

The second vertical connector 240 may include contacts 273G-236S1 arranged in a column of contacts. The contacts 236S1, 236S2 of the second connector 240 may mate with contacts 367S2, 367S1, respectively, of the first connector 340 through shared holes of the midplane 100. The remaining signal contacts, as well as ground contacts, of the second vertical connector 240 may be likewise mated with respective contacts of the first vertical connector 340 through shared holes of the midplane 100. Such mating within the midplane 100 is shown by the dashed lines.

As described herein, the vertical connector 340 may be electrically connected to the right angle connector 330. The right angle connector 330 may include contacts that have different lengths than other contacts in the right angle connector 330. As described in more detail herein, the vertical connector 340 thus may include jogged contacts to offset for or equalize the different length contacts in the right-angle connector 330. For example, a first contact in the right angle connector 330 may mate with a first contact in the vertical connector 340. A second contact in the right angle connector 330 may mate with a second contact in the vertical connector 340. The first contact in the right angle connector 330 may be greater in length by a distance D1 than the adjacent second contact of the right angle connector 330. Thus, the second contact of the vertical connector 340 may be jogged by the distance D1 to increase the length of the second contact by a distance D1. The distance D1 with respect to the connectors 330, 340 may be the same as or different than the distance D1 with respect to the connector 230, 240. Thus, when a signal is sent through the first and second contacts of the right angle and vertical connectors, for example, from the daughter card 310 to the midplane 100, the signals will reach the midplane 100 simultaneously.

For example, the dielectric vertical connector housing 243, 343 of respective connectors 240, 340, interim portions of the ground contacts may extend (or jog) a first distance D1 (e.g., 2.8 mm) at an angle (e.g., 90°) from an end of the mating portion M (i.e., the blade portion) of the contact. Such an interim portion is designated "I" on the ground contact 368G. A terminal portion—designated "T" on the ground contact 368G—of each ground contact extends at an angle (e.g., 90°) from jogged portion, parallel to the mating portion. For each signal pair, one signal contact may have a jogged interim portion that extends a second distance D2 (e.g., 1.4 mm) at an angle (e.g., 90°) from an end of the mating portion (i.e., the blade portion)—designated "J" on the signal contact 367S2—of the contact. A terminal portion "U" of each first signal contact—such as contact 367S2—extends at an angle (e.g., 90°) from the jogged portion, parallel to the mating portion. A second signal contact—such as the contact 367S1—in each pair does not include a jogged interim portion. Accordingly, the terminal portion of each second signal contact extends from the mating portion M along the same line as the mating portion. It should be understood that the second signal contacts each could include a jogged interim portion, wherein the jogged interim portions of the second signal contacts extend at an angle from the mating portions by a third distance that is less than the second distance.

Thus, jogging the lengths of the signal contacts may equalize the lengths of the electrical connection between the midplane 100 and the daughtercard 310 through the contacts

367S1, 367S2 and the respective contacts of the right angle connector 330 to which the contacts 367S1, 367S2 may be connected.

It should be noted that the tail ends of the contacts within the vertical connectors 240, 340 may be jogged in the same direction, and that the tails may be equally-spaced apart from one another. For example, with reference to the connector 340 as shown in FIGS. 4A and 4B, the tail portions of the contacts in the second connector 340 all may be jogged in a direction opposite that indicated by the Z arrow. Also, for example, with reference to the connector 240 as show in FIGS. 4A and 4B, the tail portions of the contacts in the first connector 240 all may be jogged in the direction indicated by the Y arrow of FIG. 1—that is, jogged in a direction into the page.

Figure 5:
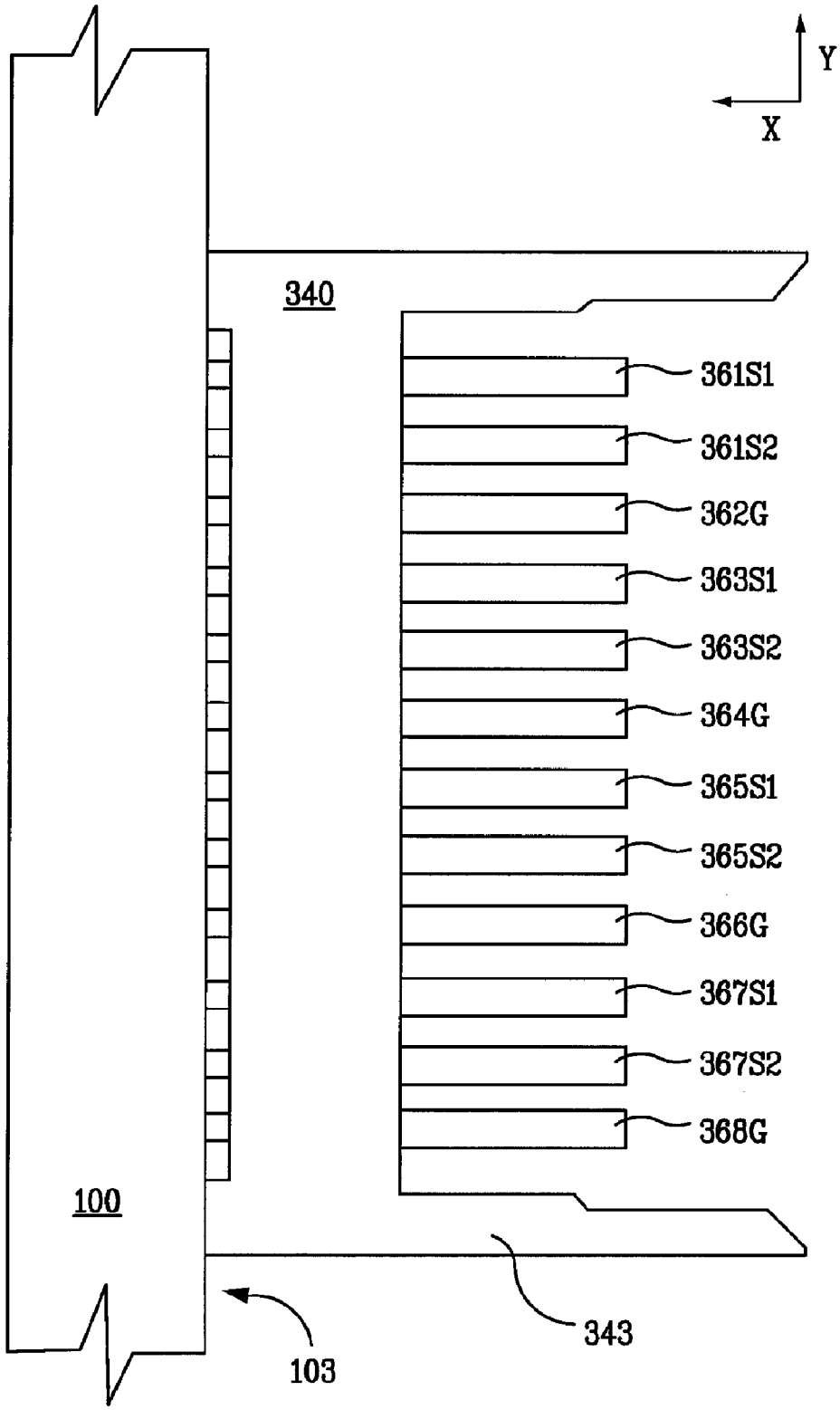
FIG. 5 is a side view of a first embodiment electrical connector mounted to a first side of a midplane.
Figure 6:
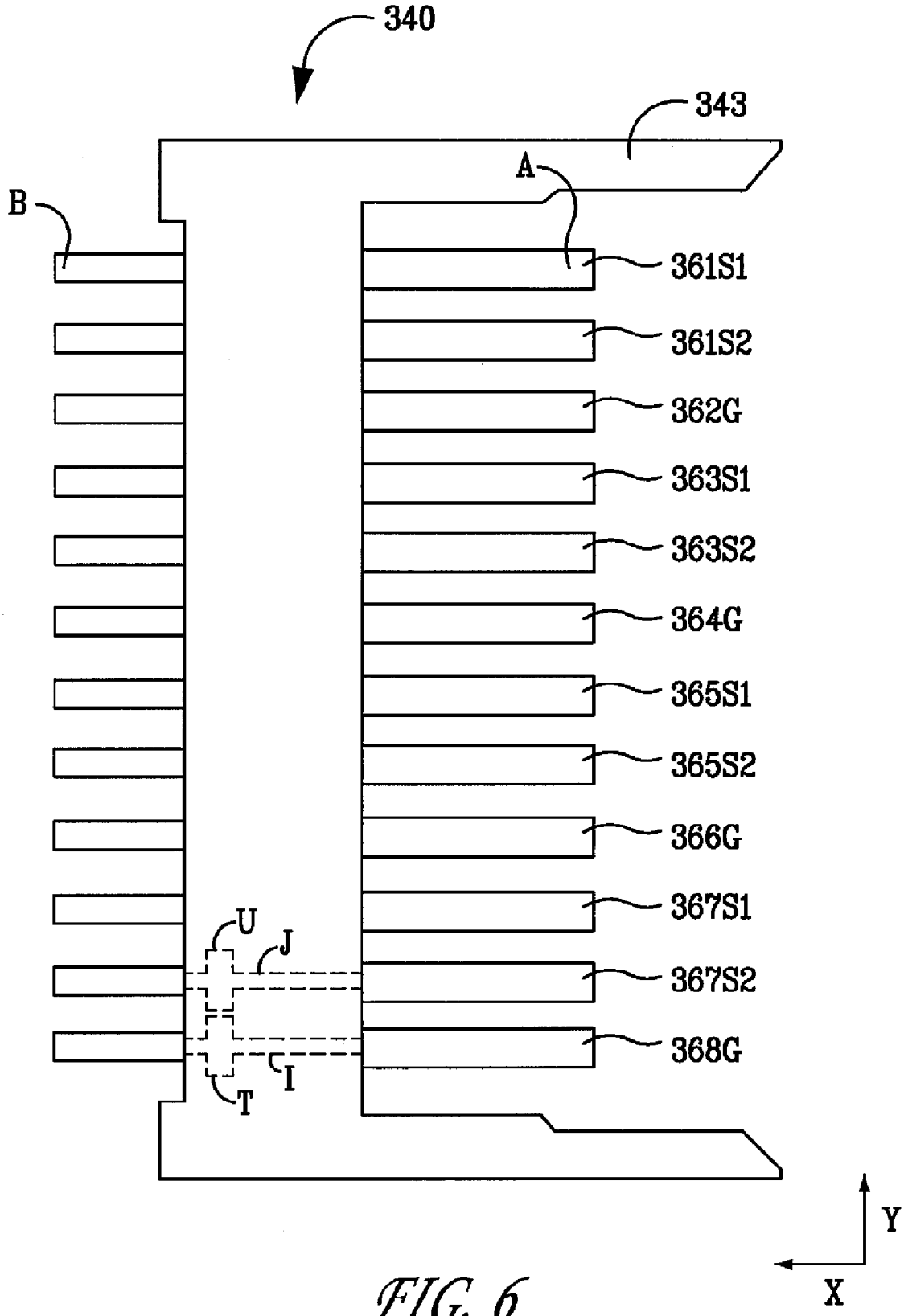
FIG. 6 is a side view of the first embodiment electrical connector oriented to be mounted to the first side of a midplane.

FIG. 5 is a side view of the first vertical connector 340 mounted to a first side 103 of the midplane 100. FIG. 6 is a side view of the first vertical connector 340 oriented to be mounted to the first side 103 of the midplane 100. As shown in FIG. 5 or 6, the vertical connector 340 may include contacts 361S1-368G extending through, received in, or overmolded as part of, a housing 343. Each of the contacts 361S1-368G may include a mating end A for mating with a corresponding receptacle contact of a right-angle or other connector. The contacts 361S1-368G may also include a mounting end B for mounting on a substrate such as the midplane 100. The portions of the contacts 361S1-368G that jog, as described herein, may be within the dielectric housing 343. As shown by the dotted lines in FIG. 6, the cross-sectional size of the contacts 361S1-368G may be adjusted (e.g., reduced, increased) where the contact is received within the housing—such as at locations I and T for ground contacts (the interim and terminal portions described herein) and U and J for signal contacts (the interim and terminal portions described herein)—to ensure proper signaling characteristics and impedance of the connector 340.

Figure 7A:
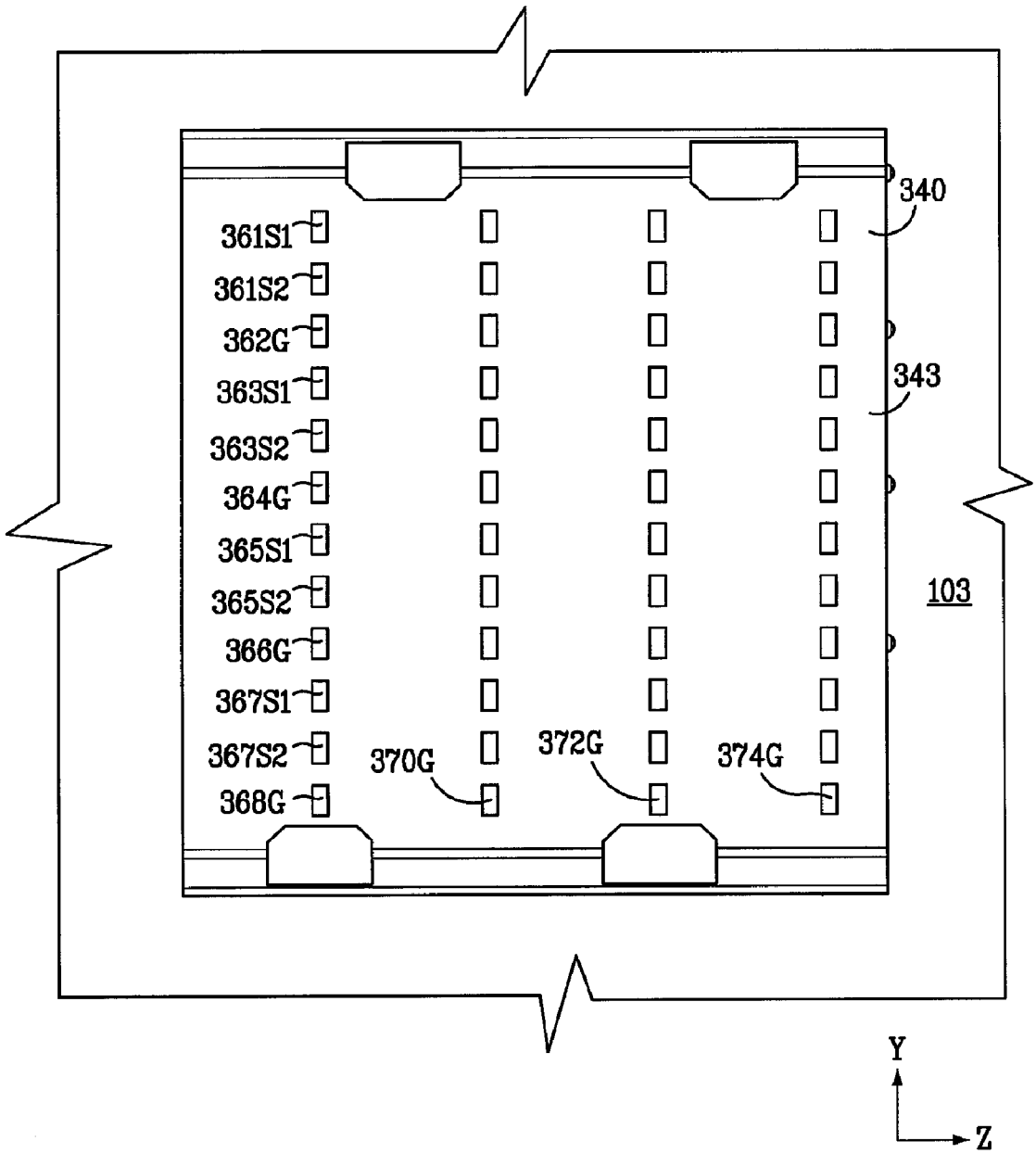
FIG. 7A is a front view of a mating side of a first embodiment electrical connector as the connector would be oriented and mounted to the first side of the midplane.

FIG. 7A is a front view of a mating side of the first embodiment electrical connector 340 as the vertical connector 340 would be oriented and mounted to the first side 103 of the midplane 100. Thus, FIG. 7A depicts a view, in the direction indicated by the arrow X of FIG. 1, of the mating side of the connector 340 shown in a plane defined by the Y and Z arrows of FIG. 1. As described herein, the connector 340 may include a column of contacts 361S1-368G extending along the Y direction. Along the "bottom" of the connector 340 may be ground contacts 368G, 370G, 372G, 374G. It should be recognized that, though the contacts are shown as including a rectangular cross section, other contact shapes (square, rounded) are envisioned for use in alternative embodiments.

Figure 8:
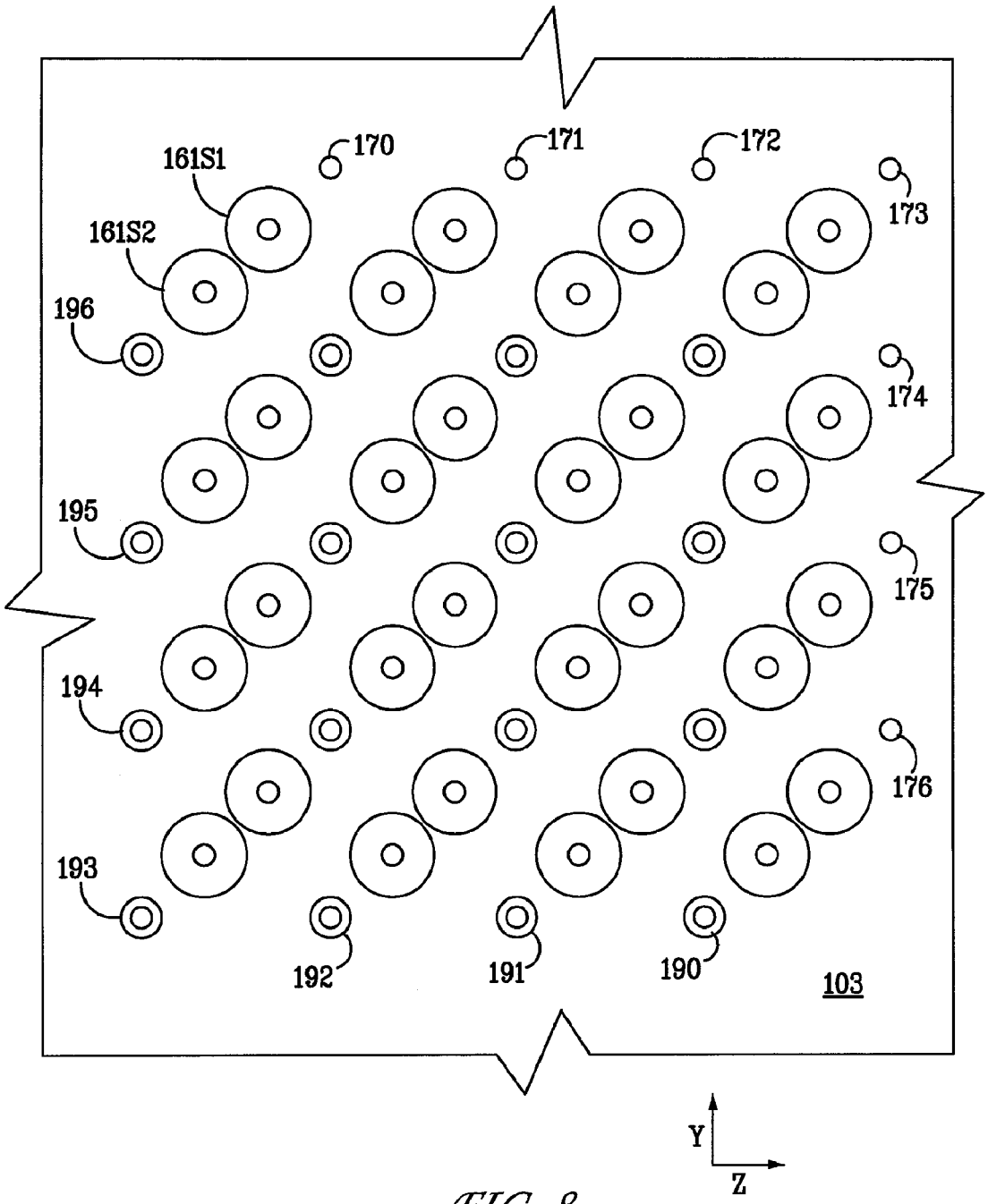
FIG. 8 depicts a midplane footprint for the first embodiment electrical connector mounted to the first side of the midplane.

FIG. 7B depicts the first embodiment electrical connector of FIG. 7A with the housing 343 of the connector hidden. As in FIG. 7A, FIG. 7B is a depiction in direction indicated by the arrow X of FIG. 1. FIG. 8 depicts a midplane footprint on the first side 103 of the midplane 100 for the example embodiment electrical connector 340, with grounds 170-176 and 190-195 shown, in addition to differential signal vias 161S1, 161S2 FIG. 7B shows the electrical connection between contacts of the vertical connector 330 and the through holes of the midplane 100. FIG. 7B also shows the jogging of contacts, such as the ground contact 368G, by the distance D1 and of contacts, such as the signal contact 367S2, by the distance D2. Thus, the signal path from the daughter card 310 to the midplane 100 through the respective contacts of the right angle connector 330 and the contacts 367S1, 327S2 may be equivalent.

The signal and ground contacts 361S1, 361S2, 362G, for example, may be mated to respective midplane through-holes 161S1, 161S2, 196. Also shown in FIG. 7B are outer ground contacts 261G, 263G, 265G, 267G, 269G, 271G, 273G of the vertical connector 230 extending from the opposite side 102 of the midplane 100 through respective through-holes 173, 172, 171, 170, 174, 175, 176.

Figure 10:
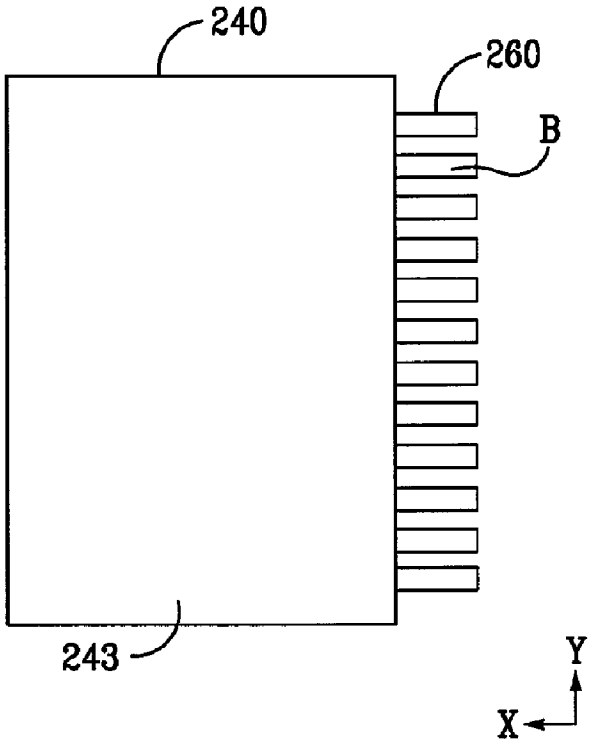
FIG. 10 is a side view of the first embodiment electrical connector oriented to be mounted to the second side of the midplane.
Figure 9:
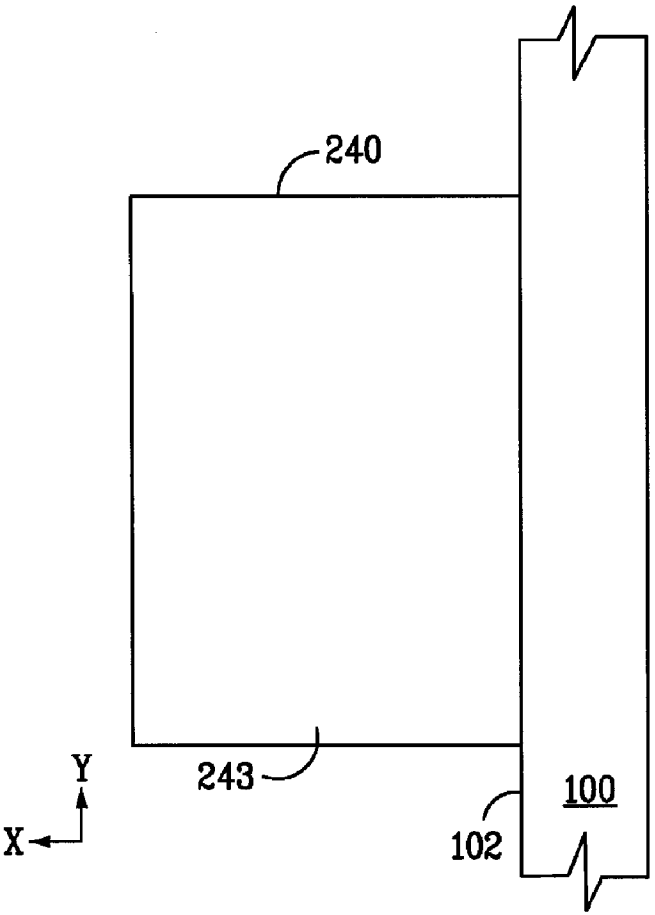
FIG. 9 is a side view of a first embodiment electrical connector mounted to a second side of a midplane.

FIG. 9 is a side view of the second vertical connector 240 with housing 243 mounted to the second side 102 of a midplane 100. FIG. 10 is a side view of vertical connector 240 oriented to be mounted to the second side 102 of the midplane 103. The vertical connector 240 may include contacts 260 extending through, received in, or overmolded as part of, a housing 243. As with the contacts of the vertical connector 340, each of the contacts 260 may include a mating end (not shown) for mating with a corresponding receptacle contact of a right-angle,such as the connector 230, or other connector. The contacts 260 may also include a mounting end B for mounting on a substrate such as the midplane 100. The portions of the contacts 260 that jog, as described herein, may be within the dielectric housing 343. As described with respect to the contacts of the vertical connector 340, the cross-sectional size of the contacts 260 may be adjusted (e.g., reduced, increased) where the contact is received within the housing to ensure proper signaling characteristics and impedance of the connector 240.

Figure 11A:
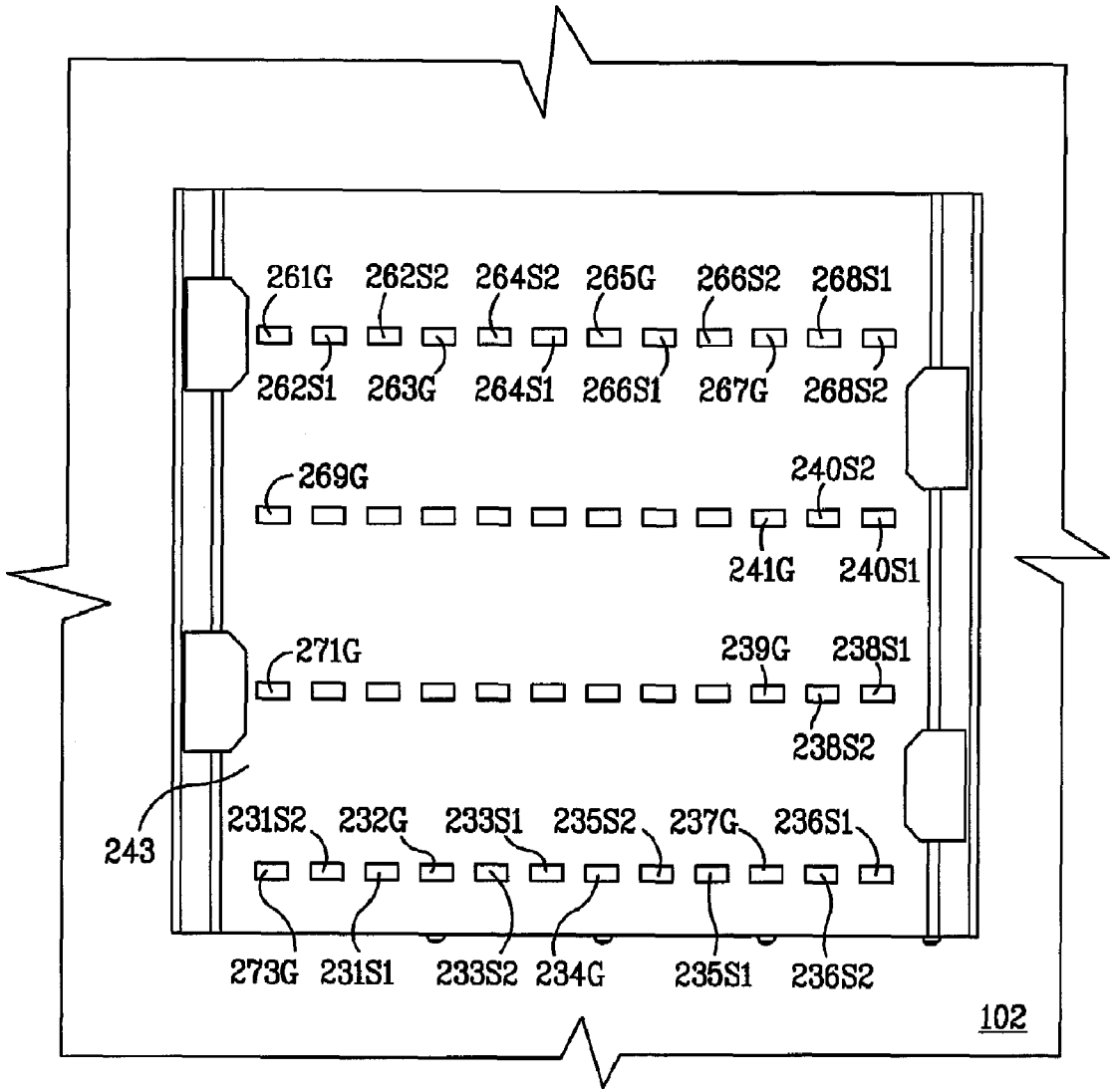
FIG. 11A is a front view of a mating side of a first embodiment electrical connector as the connector would be oriented and mounted to the second side of the midplane.

FIG. 11A is a front view of a mating side of the second electrical connector 240, with housing 243, as the connector 240 would be oriented and mounted to the second side 102 of the midplane 100. Thus, FIG. 11A depicts a view, in the direction opposite that indicated by the arrow X of FIG. 1, of the mating side of the connector 240 shown in a plane defined by the Y and Z arrows of FIG. 1. As described herein, the connector 240 may include a column of contacts 261G-268S2 extending along the Z direction. Along the left most row of the connector 240 extending along the Y direction may be ground contacts 261G, 269G, 271G, 273G. Additionally, along the "bottom" of the vertical connector 240 may be a column of contacts 273G-236S1 arranged in a signal-signal-ground arrangement. Along the right-most row of the connector 240 extending along the Y direction may be signal contacts 268S2, 240S1, 238S1, 236S1. Adjacent the right-most row may be a row of contacts 268S1, 240S2, 238S2, 236S2. The next row to the left includes contacts 267G, 241G, 239G, 237G. It should be recognized that, though the contacts are shown as including a rectangular cross section, other contact shapes (square, rounded) are envisioned for use in alternative embodiments.

Figure 11B:
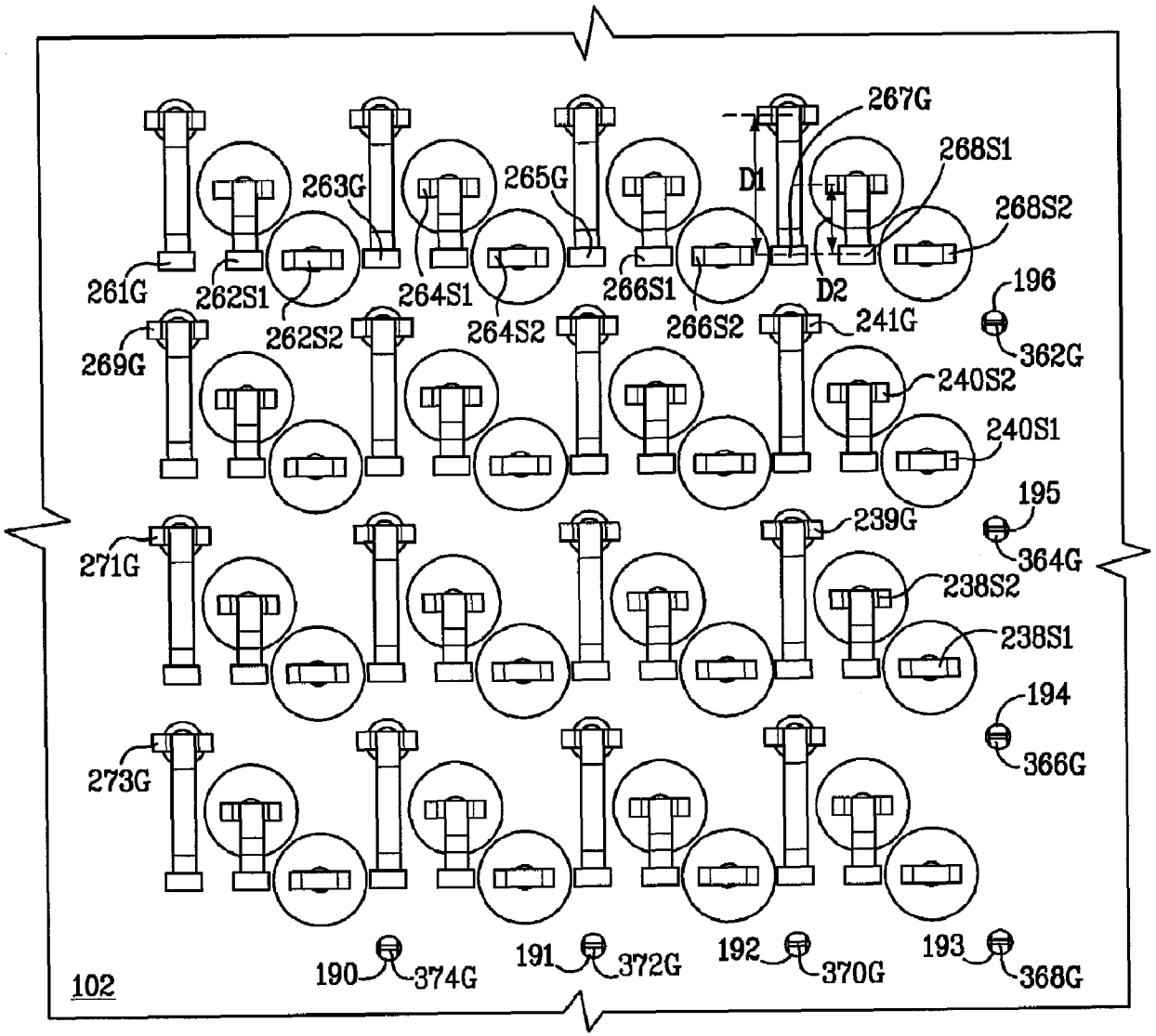
FIG. 11B depicts the first embodiment electrical connector of FIG. 11A with a housing of the connector hidden.
Figure 12:
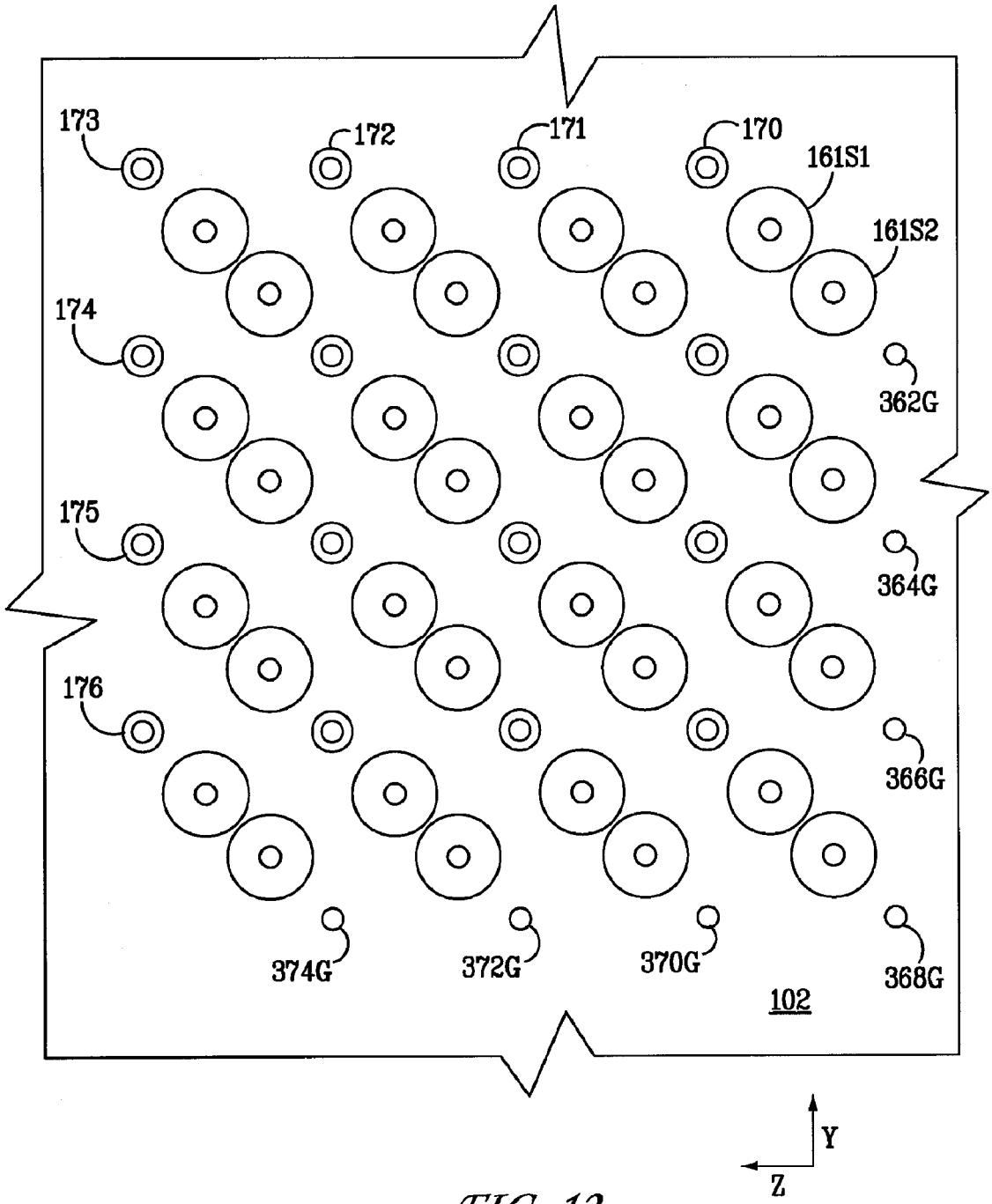
FIG. 12 depicts a midplane footprint for the first embodiment electrical connector mounted to the second side of the midplane.

FIG. 11B depicts the electrical connector 240 of FIG. 11A with the housing 243 of the connector hidden. As in FIG. 11A, FIG. 11B is a depiction in a direction opposite that indicated by the arrow X of FIG. 1. FIG. 12 depicts a midplane footprint on the side 102 of the midplane 100 for the example embodiment electrical connector 240.

FIG. 11B shows the electrical connection between contacts of the vertical connector 230 and the through holes of the midplane 100. FIG. 11B also shows the jogging of contacts, such as the contact 267G, by the distance D1 and of contacts, such as the contact 268S1, by the distance D2. Thus, the signal path from the daughter card 210 to the midplane 100 through the respective contacts of the right angle connector 230 and the contacts 267G, 268S1, 268S2 may be equivalent.

The contacts 268S1, 268S2, 267G, for example, may be mated to respective midplane through-holes 161S1, 161S2, 170. As described with respect to FIG. 1B, contacts 361S1, 361S2, 362G of the vertical connector 340 may likewise be mated to respective through holes 161S1, 161S2, 170. Therefore, contacts 268S1, 268S2, 267G may be electrically connected to, respectively, contacts 361S1, 361S2, 362G.

Also shown in FIGS. 11B and 12 are outer ground contacts 362G, 364G, 366G, 368G, 370G, 372G, 374G of the vertical connector 340 extending from the opposite side 103 of the midplane 100 through respective through-holes 196, 195, 194, 193, 192, 191, 190.

Figure 13:
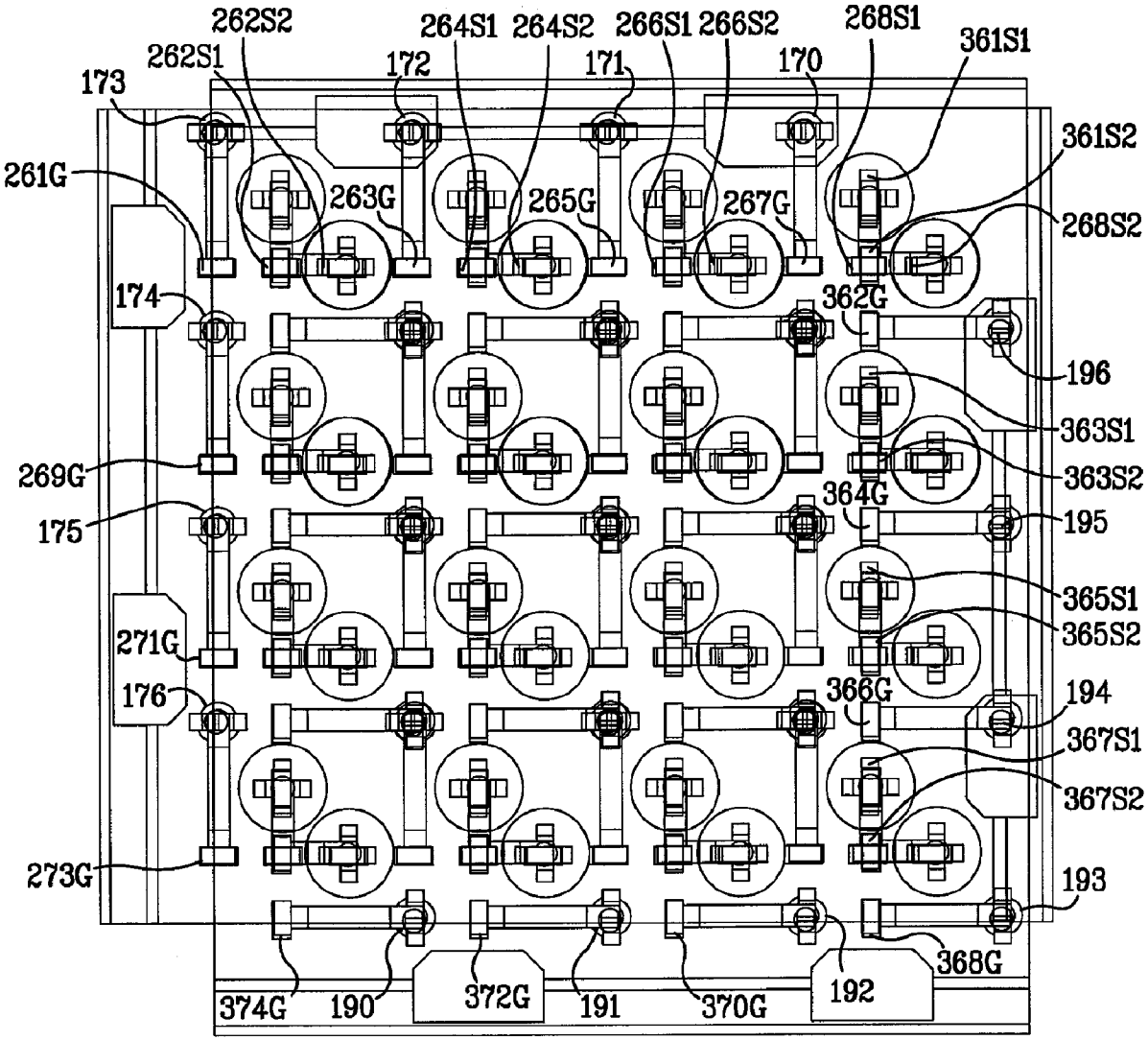
FIG. 13 is a transparent view through the midplane for the first embodiment orthogonal connection.

FIG. 13 is a transparent view through the midplane for the first embodiment orthogonal connection. FIG. 13 shows the jogging of the respective ground and first signal contacts of pairs of signal contacts. Among other things, FIG. 13 shows the mating of contacts, 268S1, 268S2 with, respectively, contacts 361S1, 361S2 through the midplane 100. The transparent view of FIG. 13 also shows how the outer grounds 261G, 263G, 265G, 267G, 273G, 271G, 269G of the connector 240 and the outer grounds 362G, 364G, 366G, 368G, 370G, 372G, 374G of the connector 340 surround the connection system described herein.

FIG. 13 further shows that in each header connector 240, 340, the tails ends of the signal contacts of the connector 240 are received into the same holes as the tail ends of complementary signal contacts from the connector 340. The short signal contacts (i.e., the signal contacts with no jogging in the tail ends) of each connector connect through the same holes to the long signal contacts (i.e., the signal contacts with jogging in the tail ends) of the other connector.

Figure 14:
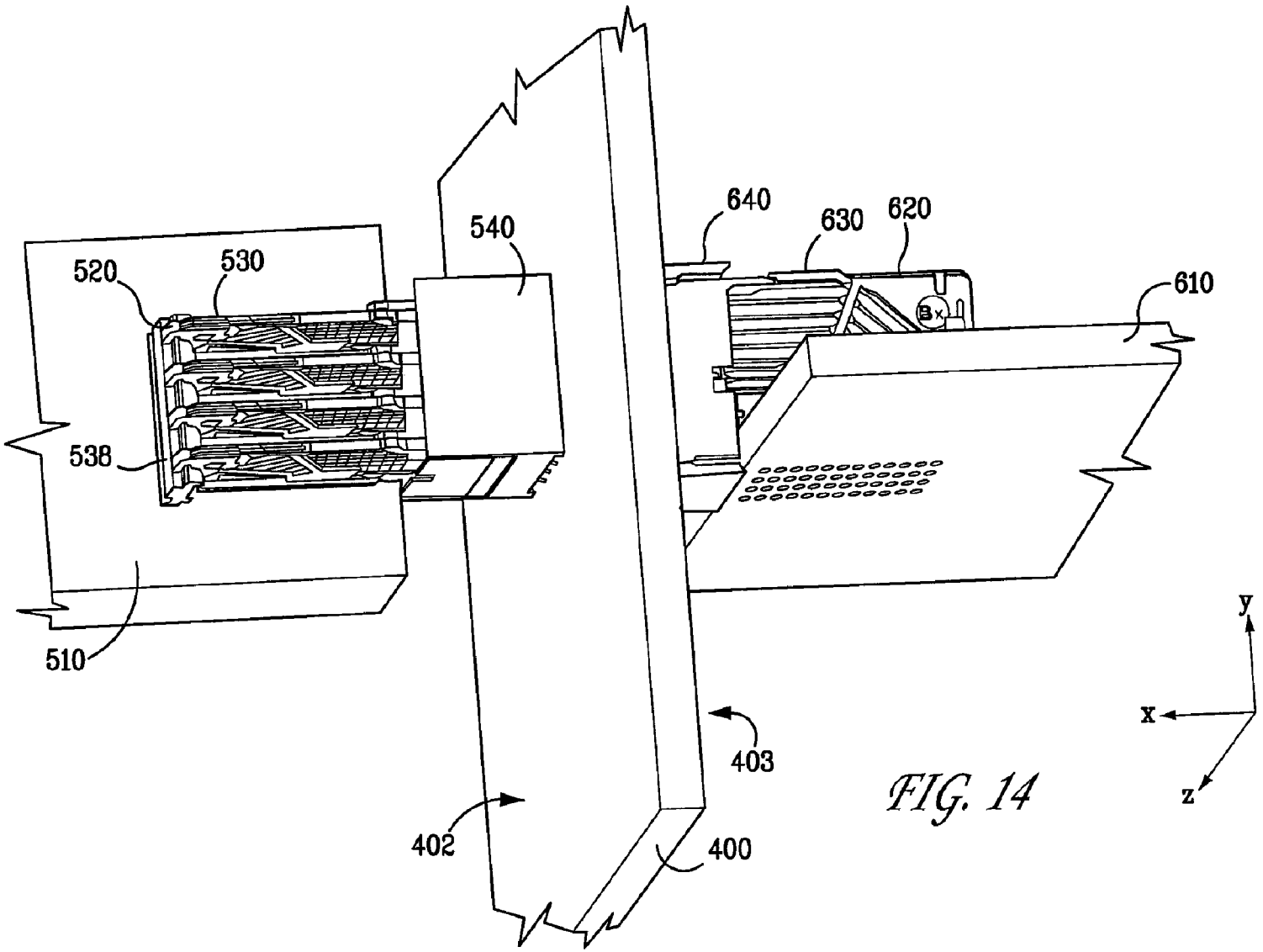
FIG. 14 depicts a pair of second embodiment electrical connectors mounted orthogonally to one another through use of shared holes in a midplane, each connector also mated with a respective right-angle connector that is mounted on a respective daughtercard.

FIGS. 14-21 depict various aspects of an alternative example embodiment electrical connector system according to the invention. FIG. 14 depicts a pair of second embodiment electrical connectors 540, 640 mounted orthogonally (e.g., the connector 540 may be rotated 90° with respect to the connector 640) to one another through use of shared holes in a midplane 400. Each connector 540, 640 may also be mated with a respective right-angle connector 530, 630 that is mounted on a respective daughtercard 510, 610. The connectors 540, 640 mounted on the midplane 400 may be vertical or header connectors. A first vertical connector 640 may be mounted to a first side 403 of the midplane 400, and a second vertical connector 540 may be mounted to a second side 402 of the midplane 400.

The midplane 400 may define a pattern of holes that extend from the first side 403 of the midplane 400 to the second side 402. Each of the vertical connectors 540, 640 may define contact tail patterns that correspond to the midplane-hole pattern. Accordingly, each hole may receive a respective contact from each of the connectors 540, 640. Thus, the connectors "share" the holes defined by the midplane 400.

Each of the right-angle connectors 530, 630 may be connected to a respective daughtercard 510, 610. The first connector 630 may be mounted on a daughtercard 610 that is horizontal. That is, the daughtercard 610 may lie in a plane defined by the arrows designated X and Z shown in FIG. 14. Of course, this "horizontal" designation may be arbitrary. The second connector 530 may be mounted to a daughtercard 510 that is "vertical." That is, the daughtercard 510 may lie in a plane defined by the arrows designated X and Y shown in FIG. 14. Thus the connector system 620 comprising the header connector 640 and the right-angle connector 630 may be called the horizontal connector system 620 or horizontal connector 620. The connector system 520 comprising the header connector 540 and the right-angle connector 530 may be called the vertical connector system 520 or the vertical connector 520. The daughtercards 510, 610 thus may be orthogonal to one another, and to the midplane 400.

Each right-angle connector 530, 630 may include lead frame assemblies, with each including contacts extending from a mating interface of the connector 530, 630 (where the connector mates with a respective vertical connector 540, 640) to a mounting interface (where the connector is mounted on a respective daughtercard 510, 610). The lead frame assemblies may be retained within a respective right-angle connector by a respective retention member.

Figure 15:
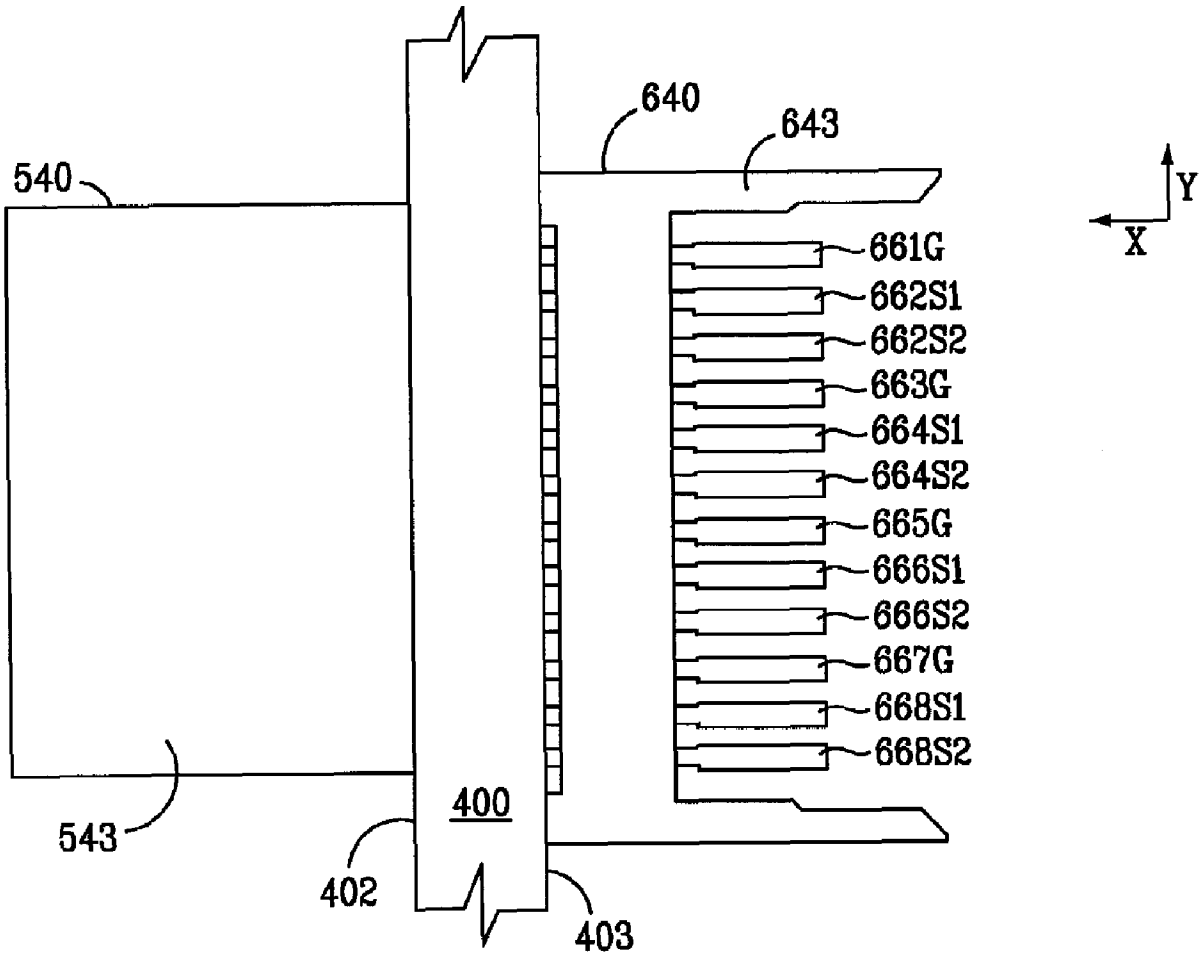
FIG. 15. is a side view of second embodiment electrical connectors mounted orthogonally to one another through use of shared holes in a midplane.
Figure 16:
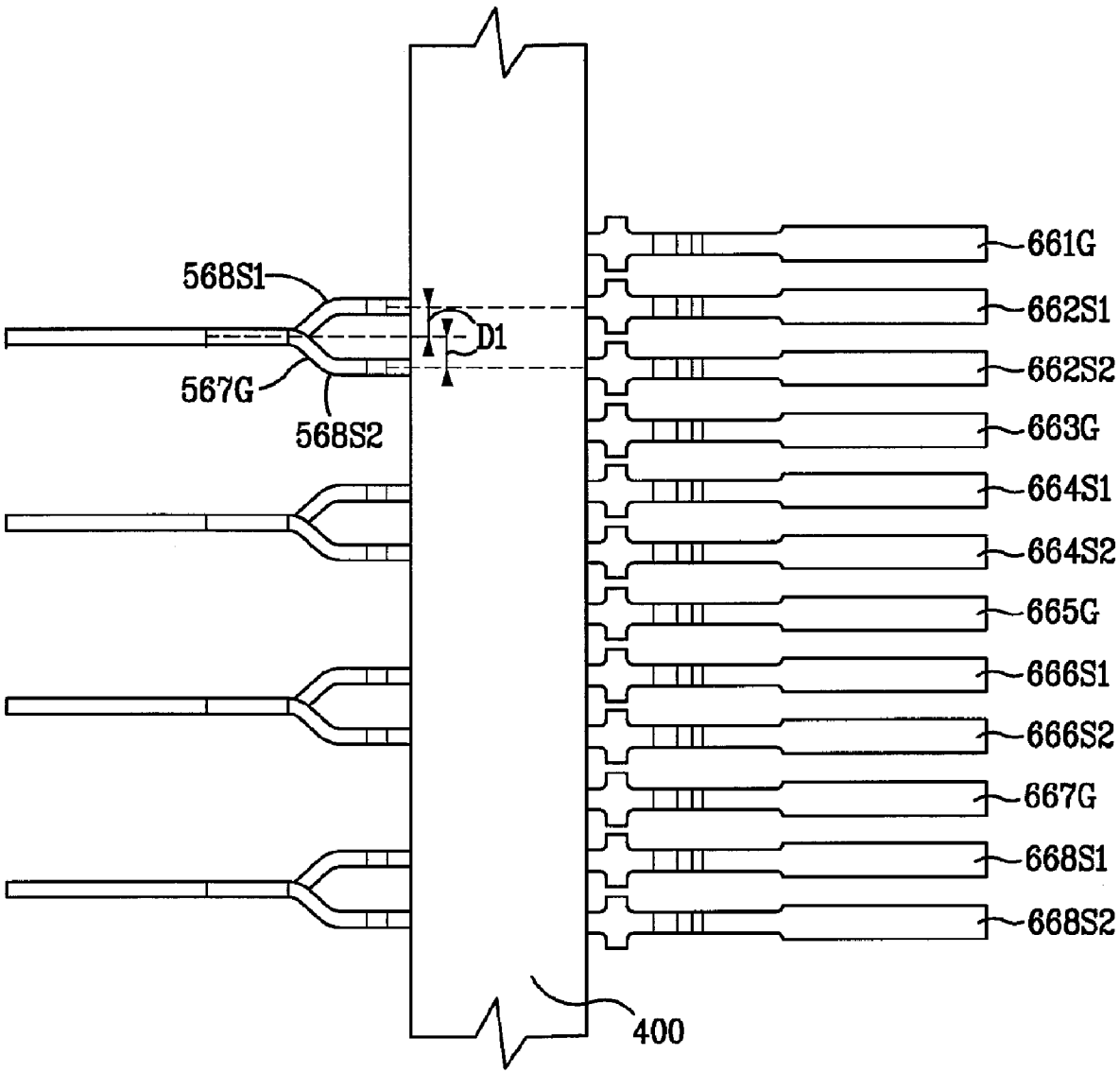
FIG. 16 is a side view as shown in FIG. 15 but with respective connector housings hidden, thus showing contact arrangements within the second embodiment electrical connectors.

FIG. 15. is a side view of second embodiment electrical connectors 540, 640 mounted orthogonally to one another through use of shared holes in a midplane. FIG. 16 is a side view as shown in FIG. 15 but with respective connector housings 543, 643 hidden, thus showing contact arrangements within the second embodiment electrical connectors. The views of the connectors 540, 640 in FIGS. 15 and 16 are in the direction indicated by the Z arrow shown in FIG. 14.

As shown, the vertical connectors 540, 640 are "male" or "plug" connectors. That is, the mating portions of the contacts in the vertical connectors 540, 640 are blade shaped. Thus the vertical connectors 540, 640 may be header connectors. Correspondingly, the right-angle connectors 530, 630 (FIG. 14) are receptacle connectors. That is, the mating portions of the contacts in the right-angle connectors 530, 630 are configured to receive corresponding blade contacts from the vertical connectors 540, 640. It should be understood, of course, that the vertical connectors 540, 640 could be receptacle connectors and the right-angle connectors 530, 630 could be header connectors.

The connectors 540, 640 may each include electrical contacts in a signal-signal-ground orientation or designation. Such orientation or designation may provide for differential signaling through the electrical connectors 540, 640. Of course, alternative embodiments of the invention may be used for single-ended signaling as well. Other embodiments may implement shields in lieu of ground contacts or connectors devoid of ground contacts and/or shields.

The contacts of each of the connectors 540, 640 may be arranged in arrays of rows and columns. Each column of contacts of the connector 640 may extend in the direction indicated by the Y arrow and each row of contacts of the connector 640 may extend in the direction indicated by the Z arrow of FIG. 14. Conversely (and because of the orthogonal relationship of the connectors 540, 640), each column of contacts of the connector 540 may extend in the direction indicated by the arrow Z of FIG. 14, and each row of contacts of the connector 540 may extend in the direction indicated by the arrow Y. Of course, the designation of the direction of rows versus columns is arbitrary.

In the example embodiments of FIGS. 15 and 16, adjacent signal contacts in each column form respective differential signal pairs. A column may begin with a ground contact, such as a contact 661G (a so-called "outer ground"), and may end with a signal contact, such as a contact 668S2. Each signal contact in a column of the connector 640 may electrically connect, through shared holes in the midplane, with a signal contact in a row of the connector 540. For example, the signal contact 662S1 of the connector 640 may connect with the signal contact 568S1 of the connector 540. It should be understood that the contacts may be arranged in any combination of differential signal pairs, single-ended signal conductors, and ground contacts in either the row or column direction. Such mating within the midplane 400 is shown by the dashed lines.

As described herein, the vertical connector 540 may be electrically connected to the right angle connector 530. The right angle connector 530 may include contacts that have different lengths than other contacts in the right angle connector 530. As described herein, for example, contacts in the right angle connector nearest the daughtercard may be shorter than contacts further from the daughtercard. Such different lengths may affect the properties of the connector 530 and the connector system 520. For example, signals may propagate through a shorter contact in the right angle connecter 530 in a shorter amount of time than a longer contact, resulting in signal skew. A header connector according to the invention may be used to affect (e.g., reduce, minimize, correct) the skew resultant from such differing contact lengths. That is, the longer signal contact in the right-angle connector can be matched with the shorter signal contact in the header connector, and the shorter signal contact in the right-angle connector can be matched with the longer signal contact in the header connector. By jogging the longer signal contact in the header connector by the right amount, skew between the longer and shorter signal contacts in the right-angle connector could be reduced or eliminated.

Within the dielectric vertical connector housing 543, 643 of respective connectors 540, 640, portions of each ground contact, such as the ground contact 567G may extend (or jog) a first distance D1 (e.g., 0.7 mm) at an angle (e.g., 45°) from an end of the mating portion (i.e., the blade portion) of the contact. A terminal portion of each ground contact, such as the ground contact 567G, may extend at an angle (e.g., 45°) from jogged portion, parallel to the mating portion.

For each signal pair, one signal contact, such as the contact 568S1 may include a jogged interim portion that extends at an angle (e.g., 45°) from an end of the mating portion (i.e., the blade portion) of the contact 568S1. A terminal (tail) portion of each first signal contact extends at an angle (e.g., 45°) from the jogged portion, parallel to the mating portion. Thus, the tail portion of the first signal contact may be offset in the first direction from the mating portion of the first signal contact by an offset distance (e.g., 0.7 mm).

The second signal contact, such as the contact 568S2 in each pair has a jogged interim portion that extends at an angle (e.g., 45°) from an end of the mating portion (i.e., the blade portion) of the contact 568S2. A terminal (tail) portion of each second signal contact extends at an angle (e.g., 45°) from the jogged portion, parallel to the mating portion. Thus, the tail portion of the second signal contact may be offset in a second direction from the mating portion of the second signal contact by an offset distance (e.g., 0.7 mm). The direction in which the tail of the second signal contact is offset from its mating portion may be the opposite of the direction in which the tail portions of the ground contact and the first signal contact are offset from their mating portions.

Figure 17A:
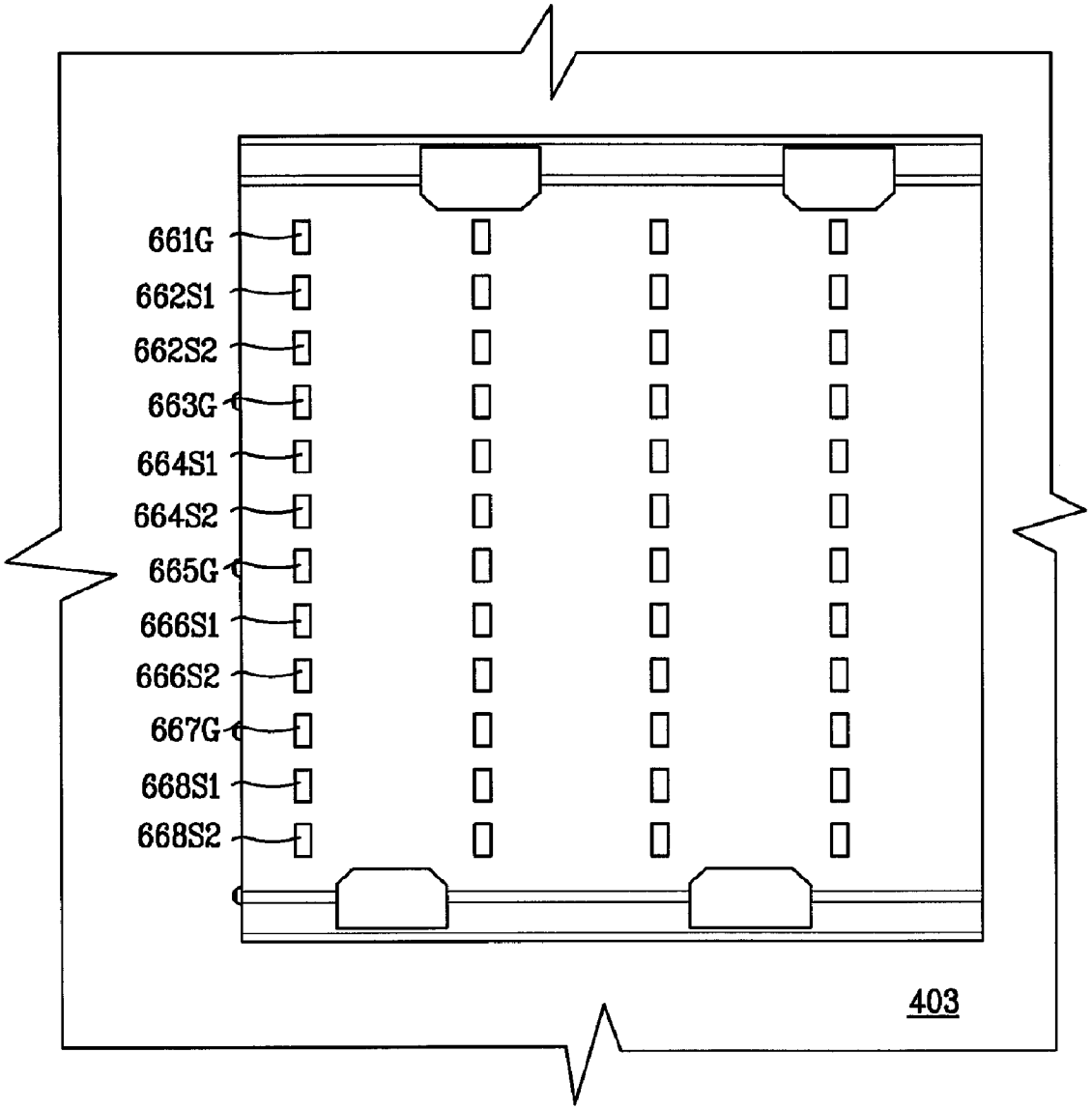
FIG. 17A is a front view of a mating side of a second embodiment electrical connector as the connector would be oriented and mounted to the first side of the midplane.

The contacts of the connector 640 likewise may be jogged in a manner similar to that described with respect to the connector 540. FIG. 17A is a front view of a mating side of an alternative embodiment electrical connector 640 as the vertical connector 640 would be oriented and mounted to the first side 403 of the midplane 400. Thus, FIG. 17A depicts a view, in the direction indicated by the arrow X of FIG. 14, of the mating side of the connector 640 shown in a plane defined by the Y and Z arrows of FIG. 14. As described herein, the connector 640 may include a column of contacts 661G-668S2 extending along the Y direction. It should be recognized that, though the contacts are shown as including a rectangular cross section, other contact shapes (square, rounded) are envisioned for use in alternative embodiments.

Figure 17B:
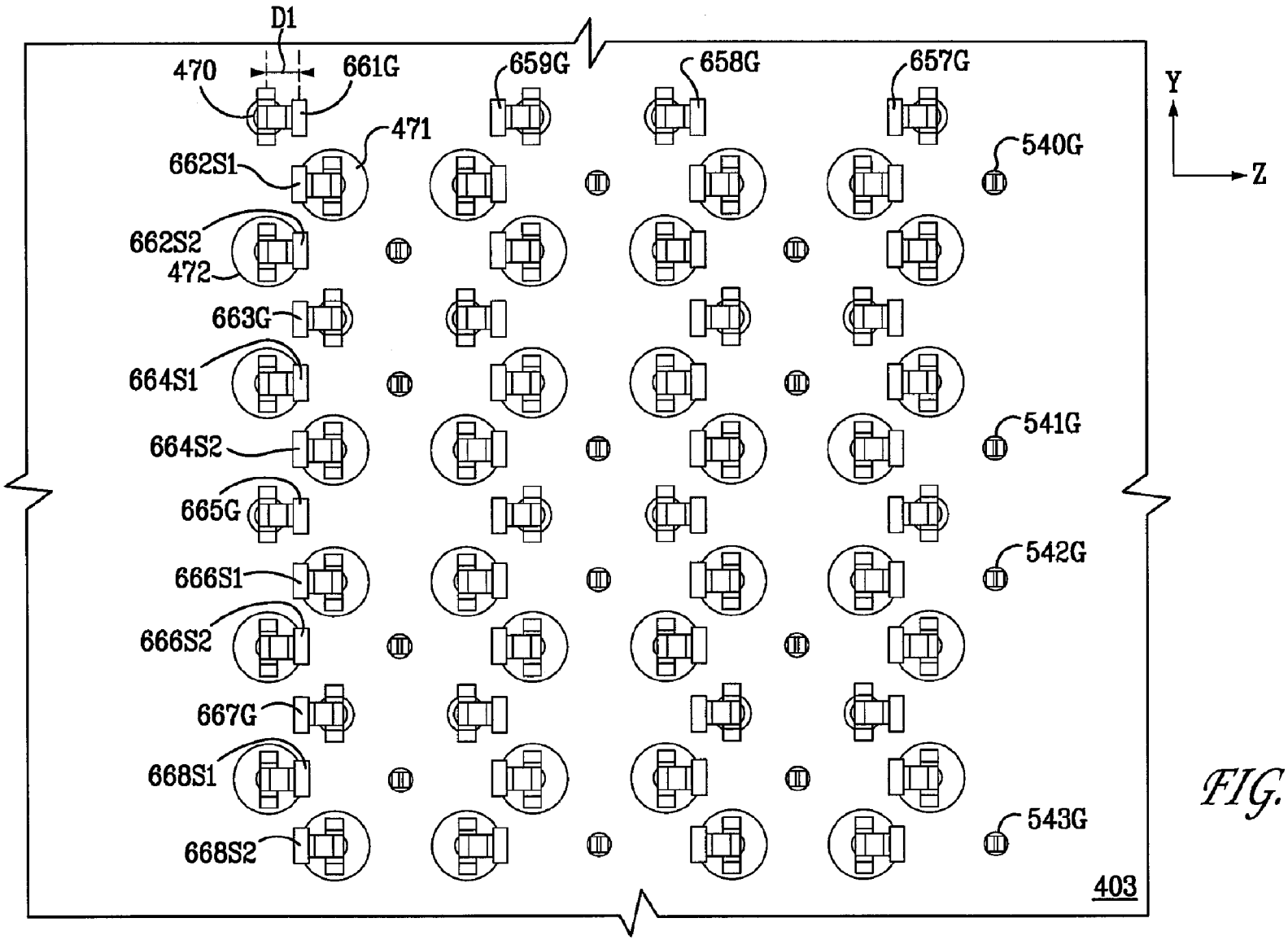
FIG. 17B depicts the second embodiment electrical connector of FIG. 17A with a housing of the connector hidden.
Figure 18:
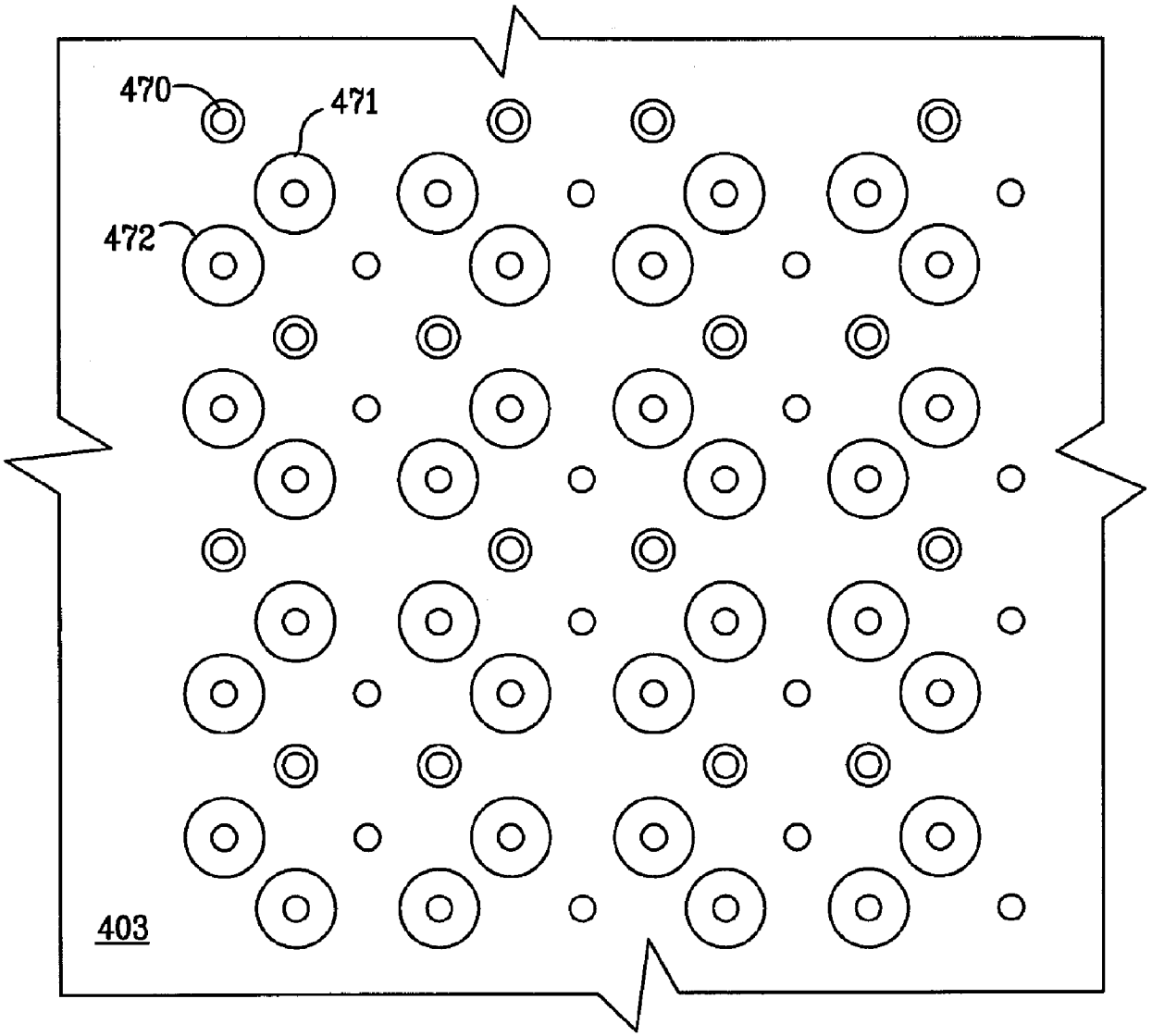
FIG. 18 depicts a midplane footprint for the first embodiment electrical connector mounted to the first side of the midplane.

FIG. 17B depicts the first embodiment electrical connector of FIG. 17A with the housing 643 of the connector hidden. As in FIG. 17A, FIG. 17B is a depiction in the direction indicated by the arrow X of FIG. 14. FIG. 18 depicts a midplane footprint for the example embodiment electrical connector on the first side 403 of the midplane 400. FIG. 17B shows the electrical connection between contacts of the vertical connector 640 and the through holes of the midplane 400. FIG. 17B also shows the jogging of contacts, such as the contact 661G, 662S1, 662S2 by the distance D1.

The signal contacts 661G, 662S1, 662S2, for example, may be mated to respective midplane through-holes 470, 471, 472. Also shown in FIG. 17B are outer ground contacts 540G, 541G, 542G, 543G of the vertical connector 540 extending from the opposite side 402 of the midplane 100 through through-holes of the midplane.

Figure 19A:
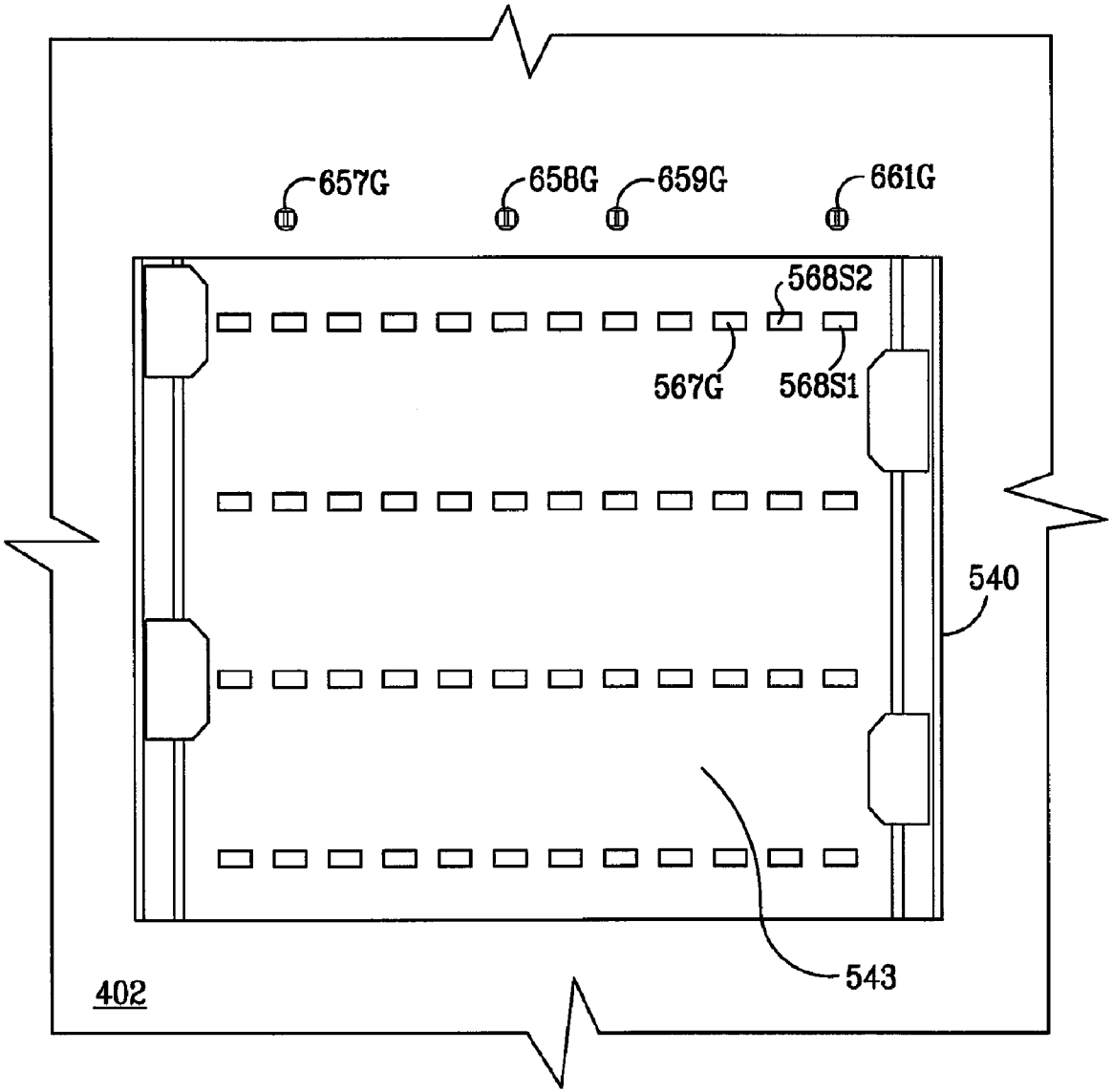
FIG. 19A is a front view of a mating side of a second embodiment electrical connector as the connector would be oriented and mounted to the second side of the midplane.
Figure 19B:
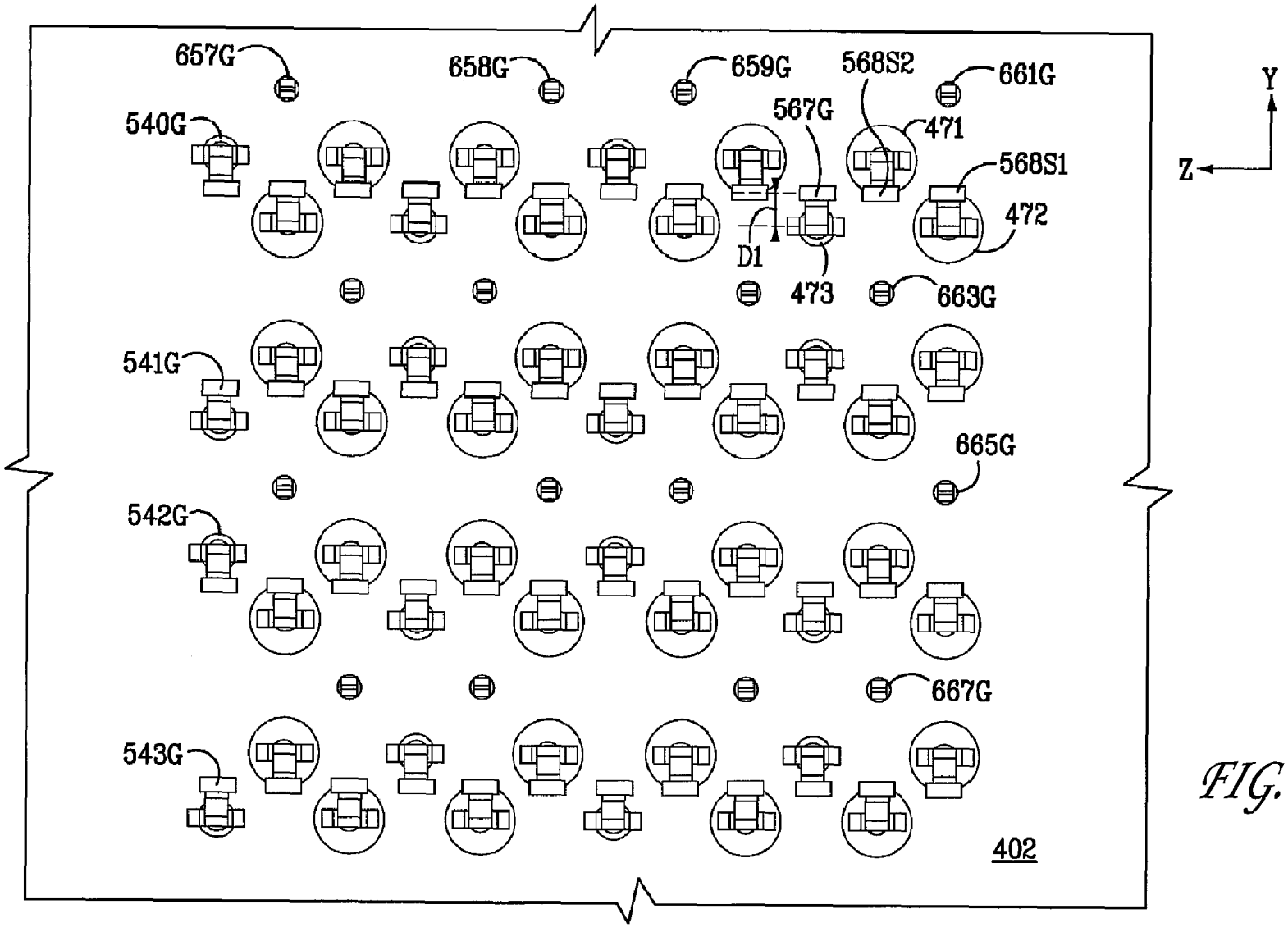
FIG. 19B depicts the second embodiment electrical connector of FIG. 19A with a housing of the connector hidden.
Figure 20:
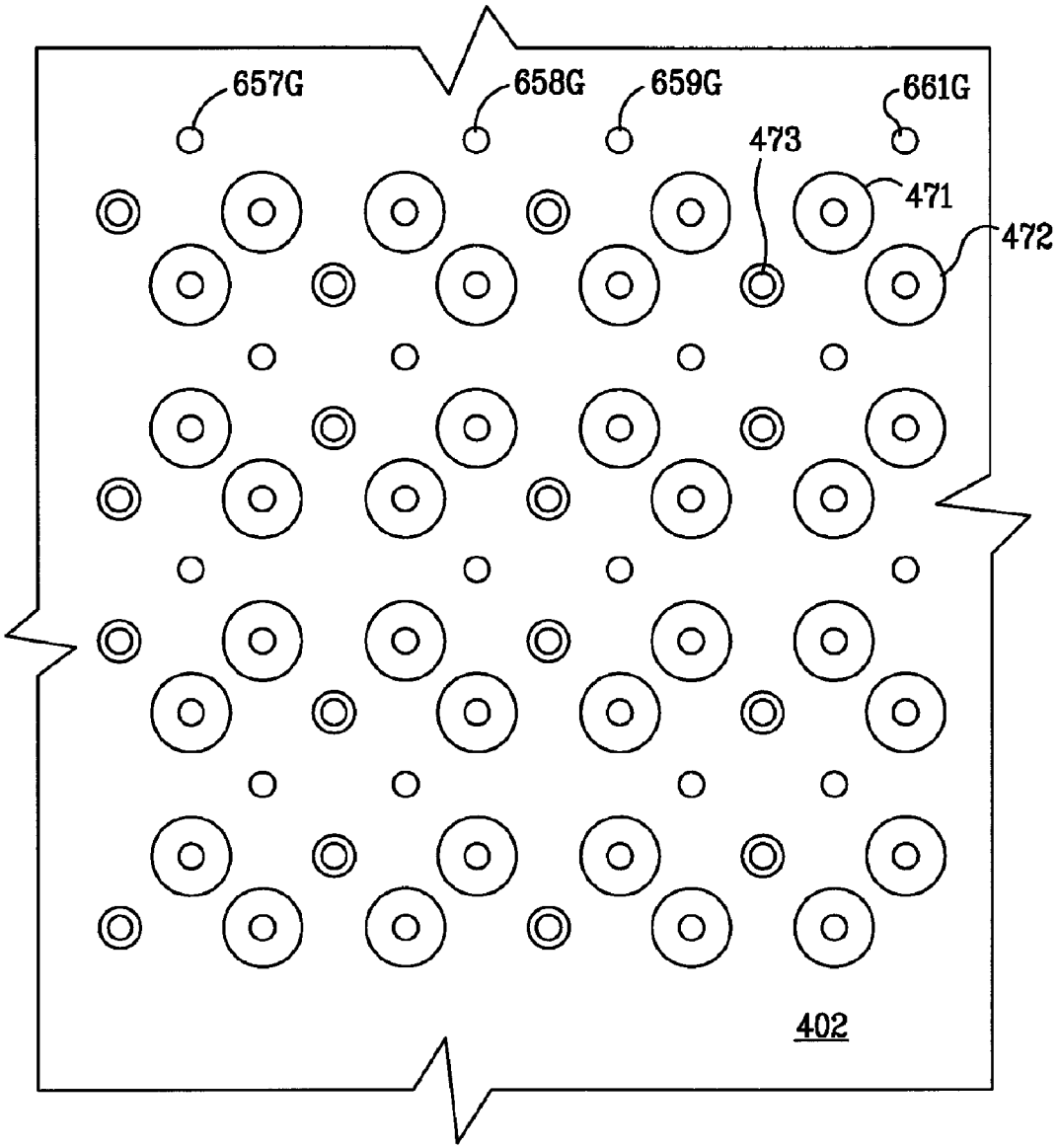
FIG. 20 depicts a midplane footprint for the second embodiment electrical connector mounted to the second side of the midplane.

FIG. 19A is a front view of a mating side of the second electrical connector 540 as the connector 540 would be oriented and mounted to the second side 402 of the midplane 400. Thus, FIG. 19A depicts a view, in the direction opposite that indicated by the arrow X of FIG. 14, of the mating side of the connector 540 shown in a plane defined by the Y and Z arrows of FIG. 14. FIG. 19B depicts the electrical connector 540 of FIG. 19A with the housing 543 of the connector hidden. As in FIG. 19A, FIG. 19B is a depiction in the direction opposite that indicated by the arrow X of FIG. 14. FIG. 20 depicts a midplane footprint for the example embodiment electrical second side 402 of the midplane 400.

FIG. 19B shows the electrical connection between contacts of the vertical connector 540 and the through-holes of the midplane 400. FIG. 19B also shows the jogging of contacts, such as the contacts 567G, 568S1, 568S2 by the distance D1.

The contacts 567G, 568S1, 568S2, for example, may be mated to respective midplane through-holes 473, 472, 471. As described with respect to FIG. 17B, contacts 662S1, 662S2 of the vertical connector 640 may likewise be mated to respective through-holes 471, 472. Therefore, contacts 568S1, 568S2 may be electrically connected to, respectively, contacts 662S2, 662S1.

Also shown in FIGS. 19B and 20 are outer ground contacts 657G, 658G, 659G, 661G of the vertical connector 640 extending from the opposite side 403 of the midplane 400.

Figure 21:
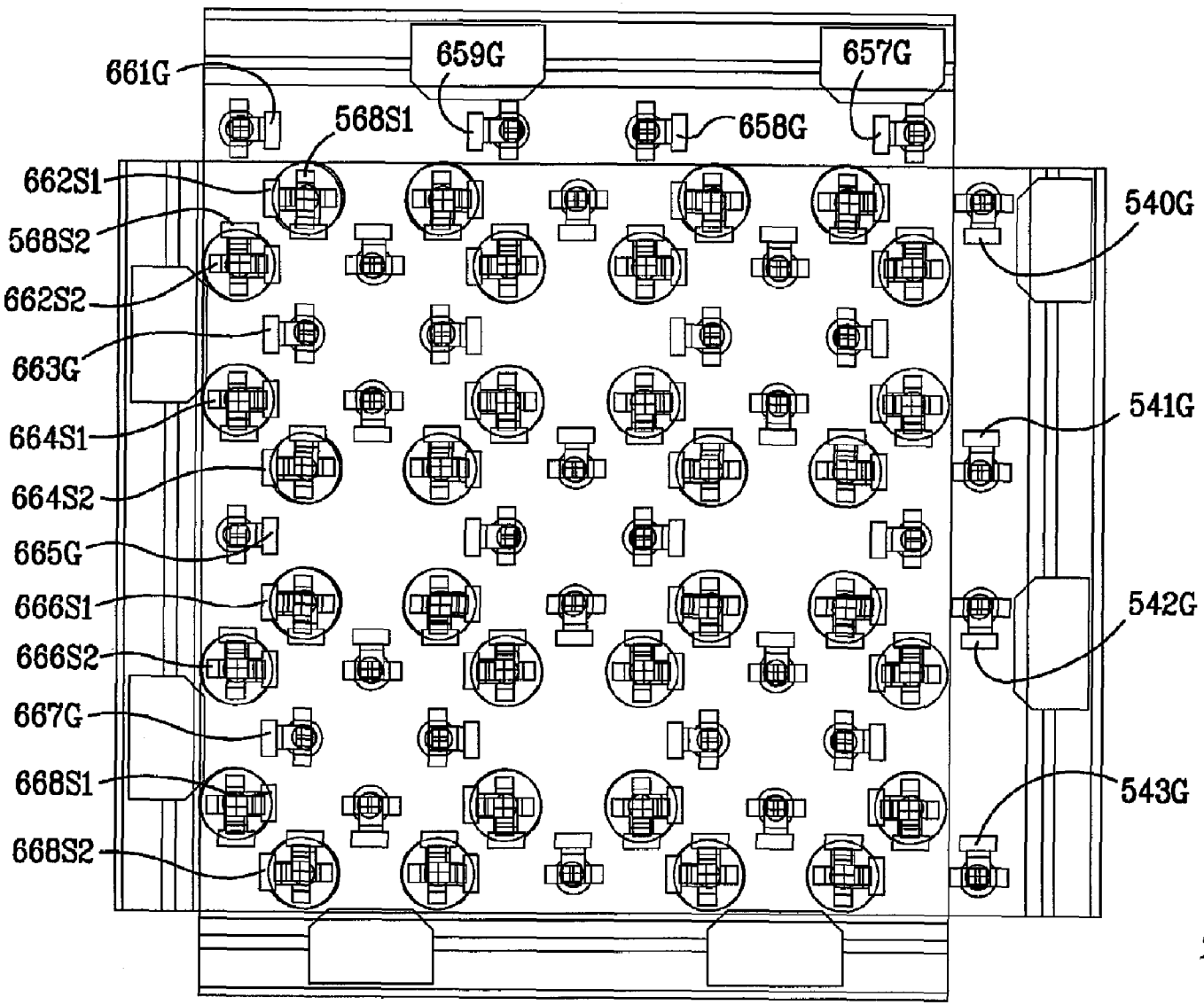
FIG. 21 is a transparent view through the midplane for the first embodiment orthogonal connection.

FIG. 21 is a transparent view through the midplane for an alternative embodiment orthogonal connection. FIG. 21 shows the jogging of the respective ground and signal contacts. Among other things, FIG. 21 shows the mating of contacts 568S1, 568S2 with, respectively, contacts 662S1, 662S2 through the midplane 400. The transparent view of FIG. 21 also shows the location of the outer grounds 657G, 658G, 659G, 661G of the connector 640 and the outer grounds 540G, 541G, 542G, 543G of the connector 540.

FIG. 21 further shows that in each header connector 540, 640, the tails ends of the signal contacts of the connector 540 are received into the same holes as the tail ends of complementary signal contacts from the connector 640.

Figure 22:
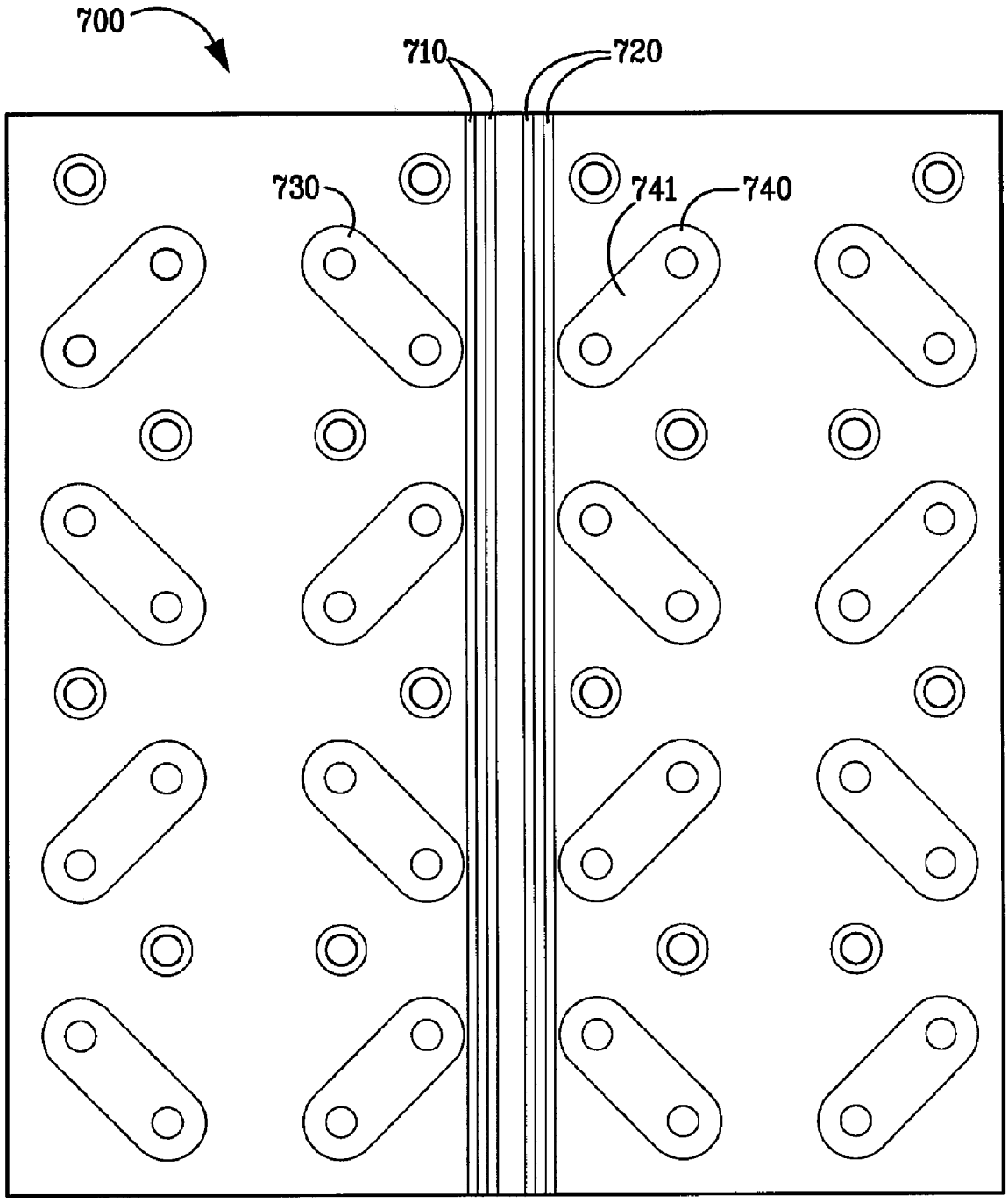
FIG. 22 provides a routing example for the second embodiment orthogonal connection.

FIG. 22 provides a routing example for the alternative embodiment orthogonal connection. The connector footprint 700 shown is the same as that depicted in FIG. 18, which is the same as the connector footprint depicted in FIG. 20 rotated 90°. As shown, two pairs 710, 720 of electrically conductive traces may be routed between two pairs of rows/columns 730, 740 that define the signal pairs. Though only two pairs of traces 710, 720 are shown in FIG. 22, it should be understood that two pairs of traces 710, 720 may be routed between each two pairs of rows/columns that define the signal pairs.

In an example embodiment, the anti-pads 741 may have a width (diameter at their ends) of about 1.25 mm (0.049"). The spacing between the anti-pads and adjacent traces may be about 0.05 mm (0.002"). Trace width may be about 0.16 mm (0.0063"). Intra-pair spacing may be about 0.16 mm (0.0063"), while inter-pair spacing may be about 0.49 mm (0.0193"). Spacing between adjacent anti-pads may be about 1.55 mm (0.061").

What is claimed is:

1. An electrical connector system, comprising:

a vertical electrical connector including:

a first vertical electrical signal contact defining a first mating end and a first mounting end, wherein the first electrical contact defines a first contact length between the mating end and the mounting end;

a second vertical electrical signal contact defining a second mating end and a second mounting end; wherein the second electrical contact defines a second contact length between the second mating end and the second mounting end, and the second length is greater than the first length; and a mounting interface configured for attachment to a substrate, and an opposing mating interface wherein the mounting interface extends in a direction substantially parallel to the mating interface; and a right-angle electrical connector configured for attachment to the mating interface of the vertical electrical connector at the mating end, the right-angle electrical connector including an IMLA, the IMLA having a first right-angle electrical contact and a second right angle electrical contact, wherein the first right-angle electrical contact is longer than the second right-angle electrical contact;

wherein the first right-angle electrical contact is configured to connect to the first vertical electrical signal contact, and the second right-angle electrical contact is configured to connect to the second vertical electrical signal contact.

2. The electrical connector system of claim 1, wherein the first vertical electrical signal contact extends substantially straight and the second vertical electrical signal contact is jogged with respect to the first electrical contact.

3. The electrical connector system of claim 1, wherein the right-angle electrical connector defines a mounting interface configured for connection to an electrical component, and the mounting interface of the right-angle connector is perpendicular to the mounting interface of the first electrical connector.

4. The electrical connector system of claim 1, wherein the first vertical electrical contact and the second right-angle electrical contact define a first combined length, and the second vertical electrical contact and the first right-angle electrical contact define a second combined length, and the first combined length is equal to the second combined length.

5. The electrical connector system of claim 1, wherein the first and second vertical electrical contacts each include a blade portion and a terminal portion, and the terminal portion of the first vertical electrical contact is jogged with respect to the blade of the first vertical electrical contact a first distance, and the terminal portion of the second vertical electrical contact is jogged with respect to the blade portion of the second vertical electrical contact a second distance, and the second distance is greater than the first distance.

6. The electrical connector system of claim 1, wherein the vertical electrical connector further comprises a third vertical electrical contact having a length greater than the length of the second electrical contact.

7. The electrical connector system of claim 6, wherein the second and third vertical electrical contacts are jogged in a same direction with respect to the first electrical contact.

8. The electrical connector system of claim 7, wherein the first and second vertical electrical contacts are signal contacts, and the third vertical electrical contact is a ground contact.

9. An electrical connector, comprising:

a first electrical contact defining a first mating end and an opposing first mounting end, and a first blade portion and a first terminal portion each extending between the first mating end and the first mounting end, wherein the first terminal portion extends parallel to the first blade portion and is offset with respect to the first blade portion in a first direction; and a second electrical contact disposed adjacent the first contact, the second electrical contact defining a second mating end and an opposing second mounting end, and a second blade portion and a second terminal portion each extending between the second mating end and the second mounting end, wherein the second terminal portion extends parallel to the second blade portion and is offset with respect to the second blade portion in a second direction;

wherein the mating portions of the first and second electrical contacts are in line with each other, and the first direction and the second direction are the same direction.

10. The electrical connector of claim 9, wherein the second and third electrical contacts each define a length between the respective mating and mounting ends, and the length of the second electrical contact is greater than the length of the third electrical contact.

11. The electrical connector of claim 9, wherein the first terminal portion is offset with respect to the first blade portion a first distance, and the second terminal portion is offset with respect to the second blade portion a second distance, and the second distance is greater than the first distance.

12. The electrical connector of claim 11, wherein the first electrical contact is a signal contact and the second electrical contact is a ground contact.

13. The electrical connector of claim 9, further comprising a third electrical contact that includes a third blade portion and a third terminal portion, wherein the third terminal portion extends parallel to, and is aligned with, the third blade portion such that the first and second terminal portions are offset in a common direction with respect to the third terminal portion.

14. The electrical connector of claim 13, wherein the first and third electrical contacts are signal contacts, and the second electrical contact is a ground contact.

15. The electrical connector of claim 13, wherein the first and third electrical contacts are configured to interface with a substrate at one end, and to corresponding first and second electrical contacts of a right-angle connector at another end, and the electrical contacts of the right-angle connector are of different lengths, so as to define two signal paths extending between the substrate and the right-angle connector, wherein the two signal paths are of equal lengths.

16. The electrical connector of claim 13, wherein the first blade portion, the second blade portion, and the third blade portion are all in line with each other.

17. An electrical connector configured for connection to a second connector having first and second skewed contacts, the electrical connector comprising:

a first electrical contact defining a first mating end, and a first mounting end disposed opposite the first mating end and aligned with the first mating end;

a second electrical contact defining a second mating end, and a second mounting end disposed opposite the second mating end and offset with respect to the first mounting end; and a third electrical contact defining a third mating end, and a third mounting end disposed opposite the third mating end and offset with respect to the first mounting end, wherein the first mating end, the second mating end, and the third mating end are in line with each other, and the second and third mounting ends are offset in a common direction with respect to the first mounting end, such that the first and second electrical contacts are configured to connect to the first and second skewed contacts so as to provide a skewless signal path.

18. The electrical connector of claim 17, wherein the first and second electrical contacts define a differential signal pair.

19. The electrical connector system of claim 18, wherein the third electrical contact defines a ground contact.

20. An orthogonal connector system, comprising:

a first electrical connector including first, second, and third electrical contacts, each contact defining a mounting end configured to be mounted to a first side of a midplane and an opposing mating end configured to attach to a respective electrical contact of first right-angle connector, such that the mounting ends extend parallel to the mating end, wherein the mating ends of the first, second, and third electrical contacts are in line with each other, and the mounting ends of the first and second electrical contacts are offset in a common direction with respect to the mounting end of the third electrical contact; and a second electrical connector including first, second, and third electrical contacts, each defining a mounting end configured to be mounted to a second side of the midplane in orthogonal relationship to the first electrical connector, and an opposing mating end configured to attach to a respective electrical contact of a second right-angle connector, wherein the mating ends of the first, second, and third electrical contacts of the second electrical connector are in line with each other, and the mounting ends of the first end second electrical contacts of the second electrical connector are offset in a common direction with respect to the mounting end of the third electrical contact of the second electrical connector, wherein the electrical contacts of the right-angle connectors are skewed, and the first and second electrical connectors are configured to connect to the respective first and second right-angle connectors so as to provide a skewless signal path between the skewed electrical contacts of the right-angle connectors.

21. The orthogonal connector system of claim 20, wherein the first electrical contact of the first electrical connector has a first length, and the second electrical contact has a second length, and the first length is greater than the second length.

22. The orthogonal connector system of claim 21, wherein the third electrical contacts of the first and second electrical connectors extend substantially straight between the mating end and the mounting end, respectively.

23. The orthogonal connector of claim 21, wherein the first and third electrical contacts of both electrical connectors are signal contacts, and the second electrical contact of both electrical connectors are ground contacts.

* * * * *